US008268527B2

(12) United States Patent
Kadota et al.

(10) Patent No.: US 8,268,527 B2
(45) Date of Patent: Sep. 18, 2012

(54) TONER, DEVELOPER, DEVELOPING DEVICE, PROCESS CARTRIDGE, IMAGE FORMING APPARATUS, IMAGE FORMING METHOD, AND METHOD OF MANUFACTURING TONER

(75) Inventors: Takuya Kadota, Kobe (JP); Yoshihiro Mikuriya, Nishinomiya (JP); Tsuyoshi Nozaki, Ikeda (JP); Atsushi Yamamoto, Numazu (JP); Yoshimichi Ishikawa, Itami (JP); Tomohiro Fukao, Minoh (JP); Tomoharu Miki, Ikeda (JP)

(73) Assignee: Ricoh Company, Limited, Tokyo (JP)

( * ) Notice: Subject to any disclaimer, the term of this patent is extended or adjusted under 35 U.S.C. 154(b) by 207 days.

(21) Appl. No.: 12/854,487

(22) Filed: Aug. 11, 2010

(65) Prior Publication Data

US 2011/0053063 A1 Mar. 3, 2011

(30) Foreign Application Priority Data

Aug. 28, 2009 (JP) ..... 2009-198060

(51) Int. Cl.
*G03G 9/08* (2006.01)

(52) U.S. Cl. ..... 430/110.2; 430/109.3; 430/137.11; 399/252

(58) Field of Classification Search ..... 430/110.2, 430/109.3, 137.11; 399/252
See application file for complete search history.

(56) References Cited

U.S. PATENT DOCUMENTS 7,550,242 B2 6/2009 Nozaki et al.
7,556,904 B2 7/2009 Kadota et al.
7,556,906 B2 7/2009 Katoh et al.
7,587,159 B2 9/2009 Fuwa et al.
7,632,619 B2 12/2009 Mikuriya et al.
7,635,549 B2 12/2009 Nakamura et al.
7,678,522 B2 3/2010 Nakamura et al.
7,695,885 B2 4/2010 Yasunaga et al.
7,709,171 B2 5/2010 Yamamoto et al.
7,720,428 B2 5/2010 Hagi et al.
7,727,694 B2 6/2010 Murakami et al.
7,749,671 B2 7/2010 Yamamoto et al.
7,811,735 B2 10/2010 Nakamura et al.
8,053,157 B2 11/2011 Jung et al.
2007/0026335 A1 2/2007 Yamamoto et al.
2007/0148568 A1 6/2007 Kadota et al.

(Continued)

FOREIGN PATENT DOCUMENTS

CN 101097413 A 1/2008

(Continued)

OTHER PUBLICATIONS

U.S. Appl. No. 12/725,094, filed Mar. 16, 2010, Tsuyoshi Nozaki et al.

(Continued)

*Primary Examiner* — Mark A Chapman
(74) *Attorney, Agent, or Firm* — Oblon, Spivak, McClelland, Maier & Neustadt, L.L.P.

(57) ABSTRACT

A toner is provided including a core particle comprising a binder resin, a colorant, and a release agent, and a shell layer comprising particles of a vinyl resin. The vinyl resin comprises 80% by weight or more of a unit of an aromatic compound having a vinyl-polymerizable functional group. A method of manufacturing the above toner is also provided, including steps of dissolving or dispersing the binder resin, the colorant, and the release agent in an organic solvent to prepare an oily liquid, dispersing the oily liquid in an aqueous medium to prepare the core particles, and adhering particles of a vinyl resin to the surfaces of the core particles to form shell layers.

17 Claims, 6 Drawing Sheets

U.S. PATENT DOCUMENTS

| | | | |
|---|---|---|---|
| 2007/0166635 | A1 | 7/2007 | Yamamoto et al. |
| 2007/0190443 | A1 | 8/2007 | Hagi et al. |
| 2007/0207399 | A1 | 9/2007 | Kadota et al. |
| 2007/0212630 | A1 | 9/2007 | Yasunaga et al. |
| 2007/0217842 | A1 | 9/2007 | Kato et al. |
| 2007/0218384 | A1 | 9/2007 | Matsumoto et al. |
| 2007/0218388 | A1 | 9/2007 | Kurose et al. |
| 2007/0218390 | A1 | 9/2007 | Nozaki et al. |
| 2007/0218393 | A1 | 9/2007 | Nozaki et al. |
| 2007/0238042 | A1 | 10/2007 | Yasunaga et al. |
| 2008/0063957 | A1 | 3/2008 | Murakami et al. |
| 2008/0069608 | A1 | 3/2008 | Katoh et al. |
| 2008/0069617 | A1 | 3/2008 | Matsumoto et al. |
| 2008/0070149 | A1 | 3/2008 | Kato et al. |
| 2008/0081273 | A1 | 4/2008 | Murakami et al. |
| 2008/0096119 | A1 | 4/2008 | Yamamoto et al. |
| 2008/0101823 | A1 | 5/2008 | Katoh et al. |
| 2008/0124635 | A1 | 5/2008 | Nakamura et al. |
| 2008/0131797 | A1 | 6/2008 | Ishikawa et al. |
| 2008/0153018 | A1 | 6/2008 | Mikuriya et al. |
| 2008/0159777 | A1 | 7/2008 | Fuwa et al. |
| 2008/0175630 | A1 | 7/2008 | Yasunaga et al. |
| 2008/0176159 | A1 | 7/2008 | Matsumoto et al. |
| 2008/0220357 | A1 | 9/2008 | Nozaki et al. |
| 2008/0226356 | A1 | 9/2008 | Yasunaga et al. |
| 2008/0227001 | A1 | 9/2008 | Kadota et al. |
| 2008/0227009 | A1 | 9/2008 | Fuwa et al. |
| 2008/0227013 | A1 | 9/2008 | Kadota et al. |
| 2008/0227016 | A1 | 9/2008 | Nozaki et al. |
| 2008/0232857 | A1 | 9/2008 | Matsumoto et al. |
| 2008/0233497 | A1 | 9/2008 | Yamamoto et al. |
| 2008/0233506 | A1 | 9/2008 | Hagi et al. |
| 2008/0233510 | A1 | 9/2008 | Nozaki et al. |
| 2008/0233511 | A1 | 9/2008 | Ishikawa et al. |
| 2008/0279591 | A1 | 11/2008 | Yasunaga et al. |
| 2009/0017391 | A1 | 1/2009 | Yamamoto et al. |
| 2009/0041511 | A1 | 2/2009 | Fuwa et al. |
| 2009/0052952 | A1 | 2/2009 | Katoh et al. |
| 2009/0117481 | A1 | 5/2009 | Yasunaga et al. |
| 2009/0169270 | A1 | 7/2009 | Fuwa et al. |
| 2009/0186289 | A1 | 7/2009 | Nakamura et al. |
| 2009/0186291 | A1 | 7/2009 | Mikuriya et al. |
| 2009/0220879 | A1 | 9/2009 | Matsumoto et al. |
| 2009/0232542 | A1 | 9/2009 | Yamamoto et al. |
| 2009/0233199 | A1 | 9/2009 | Nozaki et al. |
| 2009/0257792 | A1 | 10/2009 | Nakamura et al. |
| 2009/0297975 | A1 | 12/2009 | Ishikawa et al. |
| 2009/0297976 | A1 | 12/2009 | Yamamoto et al. |
| 2010/0009282 | A1 | 1/2010 | Katoh et al. |
| 2010/0055603 | A1 | 3/2010 | Nozaki et al. |
| 2010/0068646 | A1 | 3/2010 | Yamamoto |
| 2010/0150609 | A1 | 6/2010 | Nozaki et al. |

FOREIGN PATENT DOCUMENTS

| | | |
|---|---|---|
| CN | 101473274 A | 7/2009 |
| JP | 5-333587 | 12/1993 |
| JP | 2006-285188 | 10/2006 |
| JP | 4134057 | 6/2008 |
| JP | 2008-191365 | 8/2008 |

OTHER PUBLICATIONS

Chinese Office Action issued Mar. 19, 2012 in patent application No. 201010266083.0.

TONER, DEVELOPER, DEVELOPING DEVICE, PROCESS CARTRIDGE, IMAGE FORMING APPARATUS, IMAGE FORMING METHOD, AND METHOD OF MANUFACTURING TONER

CROSS-REFERENCE TO RELATED APPLICATIONS

The present patent application claims priority pursuant to 35 U.S.C. §119 from Japanese Patent Application No. 2009-198060, filed on Aug. 28, 2009, which is hereby incorporated by reference herein in its entirety.

BACKGROUND

1. Field of the Invention

The present invention relates to a toner for developing latent images into visible images in electrophotography. The present invention also relates to a developer, a developing device, a process cartridge, an image forming apparatus, and an image forming method, each using the above toner, and a method of manufacturing the above toner.

2. Description of the Background

Toners for forming visible images have been widely used in electrophotographic image forming apparatuses. Generally, a toner is comprised of resin particles containing a colorant.

There are various processes of manufacturing toner. It is well known that a toner manufactured in an aqueous medium advantageously has a small particle diameter and a narrow particle diameter distribution. On the other hand, toners are preferably comprised primarily of a polyester resin, which is well fixable on a recording medium.

In view of this situation, a method of manufacturing a toner in an aqueous medium, especially a toner having a small particle diameter and a narrow particle diameter distribution and comprised primarily of a polyester resin, has proposed.

Specifically, the proposed method includes the steps of dissolving or dispersing a polyester resin and a colorant in an organic solvent to prepare an oily liquid, dispersing the oily liquid in a surfactant-containing aqueous medium to form oil droplets, removing the organic solvent from the oil droplets to form toner particles, and washing and drying the toner particles. This method may be hereinafter referred to as the dissolution suspension method.

Disadvantageously, toner particles comprised primarily of a polyester resin (hereinafter "polyester-based toner particles") are less chargeable than those comprised primarily of a styrene-acrylic resin. Such less-chargeable toner particles are disadvantageous for use in one-component developing systems, in which toner particles are charged by agitation or friction using a toner supply member (e.g., a roller), a toner bearing member (e.g., a roller), or a toner regulator (e.g., a blade), because they are inferior to two-component developing systems, in which toner particles are charged by agitation or friction with carrier particles such as iron powders, in terms of sufficient charging of toner particles.

In attempting to improve chargeability of polyester-based resin particles, one proposed approach involves providing a vinyl resin, generally having good chargeability, on the surfaces of such polyester-based resin particles.

For example, Japanese Patent Application Publication No. (hereinafter "JP-A") 2006-206851 discloses polyester-based resin particles, the surfaces of which are covered with a vinyl resin containing a large amount of methacrylic-acid-originated carboxyl groups. However, such a large amount of carboxyl groups increases hygroscopicity of the surfaces of the particles, thereby degrading chargeability especially under high-temperature and high-humidity conditions.

JP-2006-285188-A discloses a core-shell toner, in which the shell is comprised of a vinyl copolymer resin and the core is comprised of a polyester-based resin. However, the disclosed content of styrene units in the vinyl copolymer resin is too small to improve chargeability of the toner, especially under high-temperature and high-humidity conditions.

The above core-shell toner also has a problem in its manufacture process, such that when the amount of polar groups (e.g., carboxyl group) in the vinyl copolymer resin is too small, raw materials cannot be normally granulated into toner particles of the desired shape and size.

JP-H05-333587-A discloses a toner manufactured through a wet granulation process in which a polyester resin and a colorant are formed into particles under wet environments, and the particles are aggregated, dried, and ground in the succeeding processes. To improve chargeability of the resulting toner particles, chargeable fine resin particles comprised of 80 parts of styrene and 20 parts of butyl acrylate are further fixed on the surfaces of the toner particles. However, the chargeable fine resin particles cannot uniformly exist over the whole surface of the toner particle because the toner particle does not have a homogenous smooth surface owing to the way that it is manufactured.

SUMMARY

Exemplary aspects of the present invention are put forward in view of the above-described circumstances, and provide novel toner, developer, developing device, image forming apparatus, each of which produces high quality images regardless of environmental conditions.

In one exemplary embodiment, a novel toner comprises a core particle comprising a binder resin, a colorant, and a release agent, and a shell layer comprising particles of a vinyl resin. The vinyl resin comprises 80% by weight or more of a unit of an aromatic compound having a vinyl-polymerizable functional group.

Other exemplary aspects of the present invention provide a novel method of manufacturing the above toner.

In one exemplary embodiment, a novel method includes dissolving or dispersing the binder resin, the colorant, and the release agent in an organic solvent to prepare an oily liquid, dispersing the oily liquid in an aqueous medium to prepare the core particles, and adhering the particles of the vinyl resin to the surfaces of the core particles to form shell layers.

Further, other exemplary aspects of the present invention provide a novel image forming method.

In one exemplary embodiment, a novel image forming method includes uniformly charging a surface of an electrostatic latent image bearing member, irradiating the charged surface of the electrostatic latent image bearing member with light containing image information to form an electrostatic latent image thereon, forming a layer of the developer including the above toner having a predetermined thickness on a developer bearing member by a developer regulator, supplying the developer from the developer bearing member to the electrostatic latent image formed on the electrostatic latent image bearing member to develop the electrostatic latent image into a toner image, transferring the toner image from the electrostatic latent image bearing member onto a transfer medium, and fixing the toner image onto the transfer medium.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Generally, toner particles have a chargeable surface structure. One preferred embodiment of such a surface structure includes an aromatic structure, in which a unit of an aromatic compound having a vinyl-polymerizable functional group is existing. Such an aromatic structure provides a reliable electron orbital.

Figure 6:
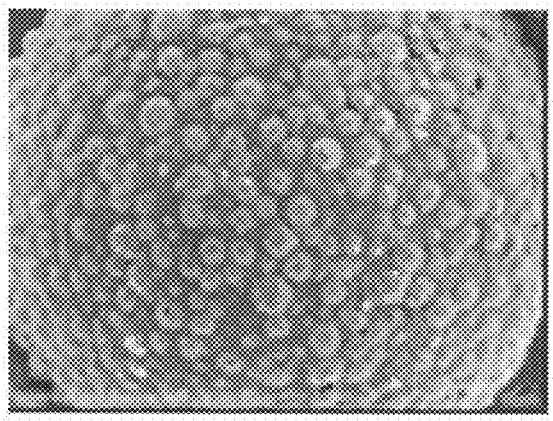
FIG. 6 is an image of a mother toner according to this specification, obtained with a scanning electron microscope (SEM)
Figure 7:
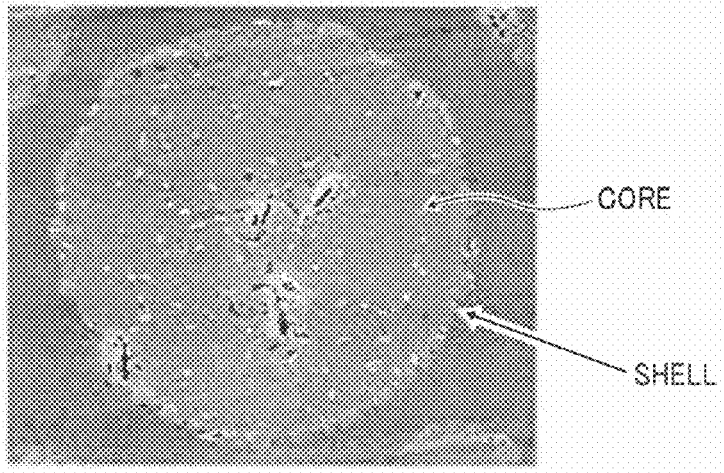
FIG. 7 is an image of a cross-section of a mother toner according to this specification, obtained with a transmission electron microscope (TEM)

Exemplary aspects of the present invention provide a toner manufactured through a process including dissolving or dispersing a resin, a colorant, and a release agent in an organic solvent to prepare an oily liquid, dispersing the oily liquid in an aqueous medium to prepare a dispersion of oil droplets (to be formed into core particles), and mixing vinyl resin particles with the dispersion of the oil droplets. The resulting toner particles have a core-shell structure in which the shell layer comprises the vinyl resin particles. The inventors of the present invention found that when the vinyl resin particles comprises 80% or more by weight of a unit of an aromatic compound having a vinyl-polymerizable functional group, the shell layer does not prevent the release agent from exuding from the core particle when the toner is fused on a recording medium. This is because such vinyl resin particles form partial shell layers on the toner particles (as shown in FIGS. 6 and 7, to be described later).

The vinyl resin particles can be prepared by polymerizing mixed monomers comprising an aromatic monomer having a vinyl-polymerizable functional group.

The mixed monomers preferably include the aromatic monomer having a vinyl-polymerizable functional group in an amount of from 80 to 100% by weight, more preferably from 90 to 100% by weight, and most preferably from 95 to 100% by weight. When the amount of such an aromatic monomer is too small, the resulting toner may have poor chargeability.

The vinyl-polymerizable functional group in the aromatic monomer may be vinyl group, isopropenyl group, allyl group, acryloyl group, or methacryloyl group, for example.

Specific examples of the aromatic monomer having a vinyl-polymerizable functional group include, but are not limited to, styrene, α-methylstyrene, 4-methylstyrene, 4-ethylstyrene, 4-tert-butylstyrene, 4-methoxystyrene, 4-ethoxystyrene, 4-carboxystyrene or metal salts thereof, 4-styrenesulfonic acid or metal salts thereof, 1-vinylnaphthalene, 2-vinylnaphthalene, allylbenzene, phenoxyalkylene glycol acrylate, phenoxyalkylene glycol methacrylate, phenoxypolyalkylene glycol acrylate, and phenoxypolyalkylene glycol methacrylate.

Among these aromatic monomers, styrene is preferable because of its good chargeability and availability.

The mixed monomers may optionally include 0 to 7% by weight of an acid monomer having both a vinyl-polymerizable functional group and an acid group. More preferably, the mixed monomers include the acid monomer in an amount of from 0 to 4% by weight, and more preferably, 0%. When the amount of the acid monomer is greater than 7% by weight, the resulting vinyl resin particles may have high dispersion stability. Such vinyl resin particles are likely not to be adhered to the core particles, or to easily release from the core particles in the processes of solvent removal, washing, drying, and external treatment of the toner. When the amount of the acid monomer is 4% or less, the resulting toner may have reliable chargeability regardless of environmental conditions.

The acid group in the acid monomer may be carboxyl group, sulfonyl group, or phosphonyl group, for example.

Specific examples of the acid monomer having both a vinyl-polymerizable functional group and an acid group include, but are not limited to, carboxyl-group-containing vinyl monomers and salts thereof (e.g., acrylic acid, methacrylic acid, maleic acid, maleic anhydride, monoalkyl maleate, fumaric acid, monoalkyl fumarate, crotonic acid, itaconic acid, monoalkyl itaconate, itaconic acid glycol monoether, citraconic acid, monoalkyl citraconate, cinnamic acid), sulfonic-group-containing vinyl monomers, vinyl sulfuric acid monoesters and salts thereof, phosphate-group-containing vinyl monomers. Among these acid monomers, acrylic acid, methacrylic acid, maleic acid, maleic anhydride, monoalkyl maleate, fumaric acid, and monoalkyl fumarate are preferable.

The vinyl resin particles can be prepared by the following non-limiting methods (a) to (f), for example.

(a) Subjecting the mixed monomers to a polymerization reaction such as suspension polymerization, emulsion polymerization, seed polymerization, or dispersion polymerization, thus preparing a dispersion of the vinyl resin particles.

(b) Subjecting the mixed monomers to a polymerization reaction, pulverizing the resulting resin with a mechanical rotary pulverizer or a jet pulverizer, and classifying the pulverized particles by size.

(c) Subjecting the mixed monomers to a polymerization reaction, dissolving the resulting resin in a solvent, and spraying the resulting resin solution into a fine mist.

(d-1) Subjecting the mixed monomers to a polymerization reaction, dissolving the resulting resin in a solvent, adding a solvent to the resulting resin solution to deposit the vinyl resin particles, and removing the solvent.

(d-2) Subjecting the mixed monomers to a polymerization reaction, dissolving the resulting resin in a solvent by application of heat, cooling the resulting resin solution to deposit the vinyl resin particles, and removing the solvent.

(e) Subjecting the mixed monomers to a polymerization reaction, dissolving the resulting resin in a solvent, dispersing the resulting resin solution in an aqueous medium in the presence of a dispersing agent, and removing the solvent by application of heat or pressure reduction.

(f) Subjecting the mixed monomers to a polymerization reaction, dissolving the resulting resin in a solvent, dissolving an emulsifier in the resulting resin solution, and adding water thereto to perform phase-inversion emulsification.

Among the above methods, (a) is preferable because the vinyl resin particles are easily preparable in the form of a dispersion. The dispersion is easy to handle in the succeeding processes.

In the method (a), in order to improve dispersion stability of the resulting vinyl resin particles, the polymerization reaction is preferably performed in an aqueous medium containing a dispersion stabilizer, and/or the mixed monomers preferably include a reactive emulsifier, which is a monomer capable of providing the resulting resin particles with dispersion stability. Without the dispersion stabilizer and/or the reactive emulsifier, the resulting vinyl resin may not be formed into particles, or the resulting vinyl resin particles may aggregate when stored. Alternatively, the core particles may aggregate or coalesce in the process of adhering the vinyl resin particles thereto, resulting in irregular toner particles with various sizes and shapes.

Specific examples of usable dispersion stabilizer include, but are not limited to, anionic surfactants (e.g., alkylbenzene sulfonate, α-olefin sulfonate, phosphate), cationic surfactants (e.g., amine-salt types such as alkyl amine salts, amino alcohol fatty acid derivatives, polyamine fatty acid derivative, and imidazoline; tertiary-ammonium-salt types such as alkyl trimethyl ammonium salts, dialkyl dimethyl ammonium salts, alkyl dimethyl dibenzyl ammonium salts, pyridinium salts, alkyl isoquinolinium salts, and benzethonium chloride), nonionic surfactants (e.g., fatty acid amide derivatives, polyalcohol derivatives), ampholytic surfactants (e.g., alanine, dodecyldi(aminoethyl) glycine, di(octylaminoethyl) glycine, N-alkyl-N,N-dimethylammonium betain), and inorganic disperser (e.g., tricalcium phosphate, calcium carbonate, titanium oxide, colloidal silica, hydroxyapatite).

In the process of preparing the vinyl resin particles, a chain transfer agent may be used for controlling the molecular weight of the resultant resin. Specific examples of usable chain transfer agents include, but are not limited to, hydrophobic alkyl mercaptans having a hydrocarbon group having 3 or more carbon atoms, such as butanethiol, octanethiol, decanethiol, dodecanethiol, hexadecanethiol, octadecanethiol, cyclohexyl mercaptan, thiophenol, octyl thioglycolate, octyl 2-mercaptopropionate, octyl 3-mercaptopropionate, 2-ethylhexyl mercaptopropionate, 2-mercaptoethyl octanoate, 1,8-dimercapto-3,6-dioxaoctane, decane trithiol, and dodecyl mercaptan. These hydrophobic chain transfer agents can be used alone or in combination.

The used amount of the chain transfer agent is preferably from 0.01 to 30 parts by weight, more preferably from 0.1 to 25 parts by weight, based on the total amount of the monomers. When the used amount of the chain transfer agent is too small, the resulting resin has too large a molecular weight, thereby degrading fixability of the resulting toner. Alternatively, the resulting resin may gelate in the process of the polymerization reaction. When the used amount of the chain transfer agent is too large, either the unreacted chain transfer agent remains or the resulting resin has too small a molecular weight, resulting in contamination of image forming components.

The vinyl resin particles preferably have a weight average molecular weight of from 3,000 to 300,000, more preferably from 4,000 to 100,000, and most preferably from 5,000 to 50,000. When the weight average molecular weight is too small, mechanical strength is poor. Such resin particles with poor mechanical strength may be unreliable in chargeability, and may contaminate image forming components, resulting in poor quality of the resulting image. When the weight average molecular weight is too large, it means that the number of the molecular terminals is reduced. As a result, the adhesive property of the vinyl resin molecular chains to the core particles may decrease.

The vinyl resin particles preferably have a glass transition temperature (Tg) of 40° C. or more, more preferably 50° C. or more, and most preferably 60° C. or more. When Tg is too low, the resulting toner may cause blocking when stored at a high temperature.

Next, the binder resin included in the oily liquid is described in detail. The binder resin partially or completely dissolves in an organic solvent. The binder resin preferably has an acid value of from 2 to 24 mgKOH/g. When the acid value is too large, it is likely that the binder resin migrates into the aqueous medium, resulting in deterioration of toner productivity. Alternatively, dispersion stability of the oily liquid droplets in the aqueous medium may be poor. When the acid value is too small, it means that the resulting resin has a low polarity. It is difficult for such a low-polarity resin to uniformly dispersing a colorant, which generally has a relatively high polarity, in the oily liquid droplets.

Preferably, the binder resin has a polyester skeleton in terms of fixability. Specific examples of such resins having a polyester skeleton include polyester resins and block copolymers of a polyester resin with a resin having a skeleton other than polyester, but are not limited thereto. In particular, polyester resins are more preferable in terms of uniformity of the resulting toner.

Specific examples of suitable polyester resins include, but are not limited to, ring-opening polymers of lactones, polycondensation products of hydroxycarboxylic acids, and polycondensation products of polyols with polycarboxylic acids. From the viewpoint of flexibility in molecular designing, polycondensation products of polyols with polycarboxylic acids are most preferable.

The molecular weight distribution curve of the polyester resin preferably has a peak at a molecular weight of from 1,000 to 30,000, more preferably from 1,500 to 10,000, and most preferably from 2,000 to 8,000. When the peak is observed at too low a molecular weight, the resulting toner may have poor heat-resistant storage stability. When the peak is observed at too high a molecular weight, the resulting toner may have poor fixability at low temperatures.

The polyester resin preferably has a glass transition temperature (Tg) of from 35 to 80° C., and more preferably from 40 to 70° C. When Tg is too low, the resulting toner particles may deform or coalesce under high-temperature conditions. When Tg is too high, the resulting toner may have poor fixability.

The polyol (1) for preparing the polyester resin may be a diol (1-1) or a polyol (1-2) having 3 or more valences, for example. Preferably, the polyol (1) is a diol (1-1) alone or a mixture of a diol (1-1) with a small amount of a polyol (1-2).

Specific examples of the diol (1-1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the above alicyclic diols; 4,4'-dihydroxybiphenyls (e.g., 3,3'-difluoro-4,4'-dihydroxybiphenyl); bis(hydroxyphenyl)alkanes (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl) propane, 2,2-bis(3,5-difluoro-4-hydroxyphenyl)propane (also known as tetrafluorobisphenol A), 2,2-bis(3-hydroxyphenyl)-1,1,1,3,3,3-hexafluoropropane); bis(4-hydroxyphenyl) ethers (e.g., bis(3-fluoro-4-hydroxylphenyl) ether); and alkylene oxide (e.g., ethylene oxide, propylene oxide, butylene oxide) adducts of the above bisphenols.

Among these compounds, alkylene glycols having 2 to 12 carbon atoms and alkylene oxide adducts of bisphenols are preferable, and combinations of alkylene oxide adducts of bisphenols with alkylene glycols having 2 to 12 carbon atoms are more preferable.

Specific examples of the polyol (1-2) having 3 or more valences include, but are not limited to, polyvalent aliphatic alcohols having 3 or more valences (e.g., glycerin, trimethylolethane, trimethylolpropane, pentaerythritol, sorbitol); polyphenols having 3 or more valences (e.g., trisphenol PA, phenol novolac, cresol novolac); and alkylene oxide adducts of the above polyphenols having 3 or more valences.

The polycarboxylic acid (2) for preparing the polyester resin may be a dicarboxylic acid (2-1) or a polycarboxylic acid (2-2) having 3 or more valences, for example. Preferably, the polycarboxylic acid (2) is a dicarboxylic acid (2-1) alone or a mixture of a dicarboxylic acid (2-1) with a small amount of a polycarboxylic acid (2-2) having 3 or more valences.

Specific examples of the dicarboxylic acid (2-1) include, but are not limited to, alkylene dicarboxylic acids (e.g., succinic acid, adipic acid, sebacic acid), alkenylene dicarboxylic acids (e.g., maleic acid, fumaric acid), aromatic dicarboxylic acids (e.g., phthalic acid, isophthalic acid, terephthalic acid, naphthalene dicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroisophthalic acid, 5-trifluoromethylisophthalic acid, 2,2-bis(4-carboxyphenyl)hexafluoropropane, 2,2-bis(3-carboxyphenyl) hexafluoropropane, 2,2'-bis(trifluoromethyl)-4,4'-biphenyl dicarboxylic acid, 3,3'-bis(trifluoromethyl)-4,4'-biphenyl dicarboxylic acid, 2,2'-bis(trifluoromethyl)-3,3'-biphenyl dicarboxylic acid, and hexafluoroisopropylidene diphthalic anhydride. Among these compounds, alkenylene dicarboxylic acids having 4 to 20 carbon atoms and aromatic dicarboxylic acids having 8 to 20 carbon atoms are preferable.

Specific examples of the polycarboxylic acid (2-2) having 3 or more valences include, but are not limited to, aromatic polycarboxylic acids having 9 to 20 carbon atoms (e.g., trimellitic acid, pyromellitic acid).

The polycarboxylic acid (2) may also be an acid anhydride or a lower alkyl ester (e.g., methyl ester, ethyl ester, isopropyl ester) of the above-described dicarboxylic acids (2-1) and the polycarboxylic acids (2-2) having 3 or more valences.

The equivalent ratio ([OH]/[COOH]) of hydroxyl groups [OH] in the polyol (1) to carboxyl groups [COOH] in the polycarboxylic acid (2) is from 2/1 to 1/1, preferably from 1.5/1 to 1/1.5, and more preferably from 1.3/1 to /1.3.

To more improve dynamic strength and high-temperature offset resistance of the resulting toner, the oily liquid may further include a modified resin having a terminal isocyanate group. Such a modified resin can be prepared by subjecting monomers including an isocyanate-group-containing monomer, or alternatively, preparing a resin having a terminal active hydrogen group and then reacting the resin with a polyisocyanate to introduce an isocyanate group on the terminal of the resin. The latter is more preferable because the isocyanate group can be introduced on the terminal of the resin. The active hydrogen group may be a hydroxyl group (e.g., alcoholic hydroxyl group, phenolic hydroxyl group), an amino group, a carboxyl group, or a mercapto group, for example. Among these groups, an alcoholic hydroxyl group is most preferable.

The modified resin preferably has the same skeleton as the above-described binder resin included in the oily liquid, i.e., a polyester skeleton, in terms of uniformity of the resulting toner particles. For example, a polyester resin having a terminal alcoholic hydroxyl group, which is one embodiment of the modified resin having a terminal active hydrogen group, can be prepared by subjecting a polyol and a polycarboxylic acid having a greater number of functional groups than the polyol to a polycondensation reaction.

A part of the isocyanate groups in the modified resin are hydrolyzed to amino groups in the process of dispersing the oily liquid in the aqueous medium. The resulting amino groups further react with unreacted isocyanate groups, thus elongating the modified resin. To more reliably elongate the modified resin and/or introduce cross-links to the elongated modified resin, an amine compound may be further included in the oily liquid.

The amine compound (B) may be a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked.

Specific examples of the diamine (B1) include, but are not limited to, aromatic diamines (e.g., phenylenediamine, diethyltoluenediamine, 4,4'-diaminodiphenylmetahne, tetrafluoro-p-xylylenediamine, tetrafluoro-p-phenylenediamine); alicyclic diamines (e.g., 4,4'-diamino-3,3'-dimethyldicyclohexylmethane, diamine cyclohexane, isophoronediamine); and aliphatic diamines (e.g., ethylenediamine, tetramethylenediamine, hexamethylenediamine, dodecafluorohexylenediamine, tetracosafluorododecylenediamine).

Specific examples of the polyamine (B2) having 3 or more valences include, but are not limited to, diethylenetriamine and triethylenetetramine.

Specific examples of the amino alcohol (B3) include, but are not limited to, ethanolamine and hydroxyethylaniline.

Specific examples of the amino mercaptan (B4) include, but are not limited to, aminoethyl mercaptan and aminopropyl mercaptan.

Specific examples of the amino acid (B5) include, but are not limited to, aminopropionic acid and aminocaproic acid.

Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds.

Among these amines (B), a diamine (B1) alone and a mixture of a diamine (B1) with a small amount of a polyamine (B2) having 3 or more valences are preferable.

The equivalent ratio ([NHx]/[NCO]) of amino groups [NHx] in the amine (B) to isocyanate groups [NCO] in the modified resin is 4 or less, preferably 2 or less, more preferably 1.5 or less, and most preferably 1.2 or less. When the equivalent ratio ([NHx]/[NCO]) is too large, excessive amino groups may block the isocyanate groups of the modified resin so that the modified resin cannot be elongated. As a result, the molecular weight of the resulting polyester may be too low and therefore the resulting toner may have poor high-temperature offset resistance.

Preferably, the organic solvent included in the oily liquid is a volatile solvent having a boiling point of less than 100° C. in terms of removability. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, and mixtures thereof. In a case where the organic solvent dissolves or disperses a resin having a polyester skeleton, ester solvents (e.g., methyl acetate, ethyl acetate, butyl acetate) and ketone solvents (e.g., methyl ethyl ketone, methyl isobutyl ketone) are preferable because polyesters have high solubility in such solvents. Among these organic solvents, methyl acetate, ethyl acetate, and methyl ethyl ketone are most preferable in terms of removability.

The aqueous medium may be water or a mixture of water and a water-miscible solvent, for example. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

The aqueous medium contains a surfactant, to reliably disperse the oily liquid and form oil droplets.

Specific examples of usable surfactants include, but are not limited to, anionic surfactants (e.g., alkylbenzene sulfonates, α-olefin sulfonates, phosphates), cationic surfactants (e.g., amine salt types such as alkylamine salts, amino alcohol fatty acid derivatives, polyamine fatty acid derivatives, and imidazolines; quaternary ammonium salt types such as alkyl trimethyl ammonium salts, dialkyl dimethyl ammonium salts, alkyl dimethyl benzyl ammonium salts, pyridinium salts, alkyl isoquinolinium salts, and benzethonium chlorides), nonionic surfactants (e.g., fatty acid amide derivatives, polyvalent alcohol derivatives), and amphoteric surfactants (e.g., alanine, dodecyl di(aminoethyl) glycine, di(octyl aminoethyl) glycine, N-alkyl-N,N-dimethyl ammonium betaine).

Surfactants having a fluoroalkyl group are also usable. Specific examples of anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4)sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl (C6-C16) ethyl phosphates.

Specific examples of cationic surfactants having a fluoroalkyl group include, but are not limited to, aliphatic primary, secondary, and tertiary amine acids having a fluoroalkyl group; and aliphatic tertiary ammonium salts such as perfluoroalkyl(C6-C10) sulfonamide propyl trimethyl ammonium salts, benzalkonium salts, benzethonium chlorides, pyridinium salts, and imidazolinium salts.

Alternatively, the aqueous medium may contain an inorganic dispersing agent or a particulate resin, to reliably disperse the oily liquid and form oil droplets.

Specific examples of usable inorganic dispersing agents include, but are not limited to, tricalcium phosphate, calcium carbonate, titanium oxide, colloidal silica, and hydroxyapatite.

Inorganic dispersing agents which are soluble in acids and alkalis, such as calcium phosphates, are removable from the resultant toner particles by dissolving with an acid (e.g., hydrochloric acid) and washing. Alternatively, inorganic dispersing agents can be removable with an enzyme. Dispersing agents can remain on the resultant toner particles, however, it is more preferable that the dispersing agents are removed from the resultant toner particle in terms of chargeability.

Additionally, polymeric protection colloids are usable so as to improve stability of the dispersing oil droplets.

Specific examples of usable polymeric protection colloids include, but are not limited to, homopolymers and copolymers obtained from monomers, such as acid monomers (e.g., acrylic acid, methacrylic acid, α-cyanoacrylic acid, α-cyanomethacrylic acid, itaconic acid, crotonic acid, fumaric acid, maleic acid, maleic anhydride), acrylate and methacrylate monomers having hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide), vinyl ether monomers (e.g., vinyl methyl ether, vinyl ethyl ether, vinyl propyl ether), vinyl carboxylate monomers (e.g., vinyl acetate, vinyl propionate, vinyl butyrate), amide monomers (e.g., acrylamide, methacrylamide, diacetone acrylamide) and methylol compounds thereof, acid chloride monomers (e.g., acrylic acid chloride, methacrylic acid chloride), and/or monomers containing nitrogen or a nitrogen-containing heterocyclic ring (e.g., vinyl pyridine, vinyl pyrrolidone, vinyl imidazole, ethylene imine); polyoxyethylene-based resins (e.g., polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

The oily liquid includes a colorant. Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and mixtures thereof.

The colorant can be combined with a resin to be used as a master batch. Specific examples of usable resin for the master batch include, but are not limited to, the above-described modified or unmodified polyester resins, styrene polymers and substituted styrene polymers (e.g., polystyrene, poly-p-chlorostyrene, polyvinyltoluene), styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloro methacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer), polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid, rosin, modified rosin, terpene resin, aliphatic or alicyclic hydrocarbon resin, aromatic petroleum resin, chlorinated paraffin, and paraffin wax. These resins can be used alone or in combination.

The master batches can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading process, dispersing devices capable of applying a high shearing force such as three roll mills can be preferably used.

The oily liquid further includes a release agent, to improve releasability from a fixing member of the resultant toner.

The release agent is required to express low viscosity when the resultant toner is heated to be fixed on a recording medium. Additionally, the release agent is required not to be soluble or swell in a fixing member when the resultant toner is fixed on a recording medium. Specifically, waxes and silicone oils meet such requirements. More specifically, waxes, which are generally in solid state at room temperatures, are more advantageous over silicone oils in terms of storage stability of the toner.

Specific examples of suitable waxes include, but are not limited to, long-chain hydrocarbons such as polyolefin waxes (e.g., polyethylene wax, polypropylene wax), petroleum waxes (e.g., paraffin wax, SAZOL wax, microcrystalline wax), and Fisher-Tropsch wax; and carbonyl-group-containing waxes such as polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanoic acid amides (e.g., ethylenediamine dibehenylamide), polyalkylamides (e.g., trimellitic acid tristearylamide), and dialkyl ketones (e.g., distearyl ketone).

Among these waxes, long-chain hydrocarbons are preferable because their releasability is good. A combination of a long-chain hydrocarbon with a carbonyl-group-containing wax is also preferable.

The resultant toner preferably includes the release agent in an amount of from 2 to 25% by weight, more preferably from 3 to 20% by weight, and most preferably from 4 to 15% by weight. When the amount of the release agent is too small, releasability of the toner from a fixing member is poor. When the amount of the release agent is too large, mechanical strength of the toner is poor.

The oily liquid may optionally includes a charge controlling agent.

Specific examples of usable charge controlling agents include, but are not limited to, Nigrosine dyes, triphenylmethane dyes, chromium-containing metal complex dyes, chelate compounds of molybdic acid, Rhodamine dyes, alkoxyamines, quaternary ammonium salts (including fluorine-modified quaternary ammonium salts), alkylamides, phosphor and compounds thereof, tungsten and compounds thereof, fluorine-containing activators, metal salts of salicylic acid, and metal salts of salicylic acid derivatives.

Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, and a quaternary ammonium group.

The content of the charge controlling agent in the toner is preferably from 0.5 to 5% by weight, and more preferably from 0.8 to 3% by weight, within which fixing property of the toner is not inhibited.

The toner may optionally include a magnetic material, to be used as a magnetic toner. Specific examples of usable magnetic materials include, but are not limited to, iron oxides (e.g., magnetite, ferrite, hematite), metals (e.g., iron, cobalt, nickel), alloys or mixtures of the above metals with aluminum, cobalt, copper, lead, magnesium, tin, zinc, antimony, beryllium, bismuth, calcium, cadmium, manganese, selenium, titanium, tungsten, and vanadium. The magnetic material preferably has a volume average particle diameter of from 0.1 to 2 μm. The content of the magnetic material in the toner is preferably from 5 to 150 parts by weight, based on 100 parts by weight of the resins.

The toner can be used for either a one-component developer comprising a toner and no carrier or a two-component developer comprising a toner and a carrier. The carrier may be powders of iron, ferrite, or magnetite, or glass beads, for example. The surface of the carrier particles may be covered with a resin, such as poly(carbon fluoride), polyvinyl chloride, polyvinylidene chloride, a phenol resin, polyvinyl acetal, an acrylic resin, and a silicone resin. Among these resins, silicone resins are preferable in terms of lifespan of the carrier. The resin may include powders of conductive materials, such as metals, carbon black, titanium dioxide, tin oxide, and zinc oxide. The powders of conductive materials preferably have an average particle diameter of 1 μm or less. When the average particle diameter is too large, it is difficult to control electric resistance of the carrier. The two-component developer preferably includes the toner in an amount of from 0.5 to 20.0 parts by weight, based on 100 parts by weight of the carrier.

Exemplary aspects of the present invention further provide a process cartridge. The process cartridge includes an electrostatic latent image bearing member and a developing device that develops an electrostatic latent image formed on the electrostatic latent image bearing member into a toner image with the above-described toner.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

Figure 1:
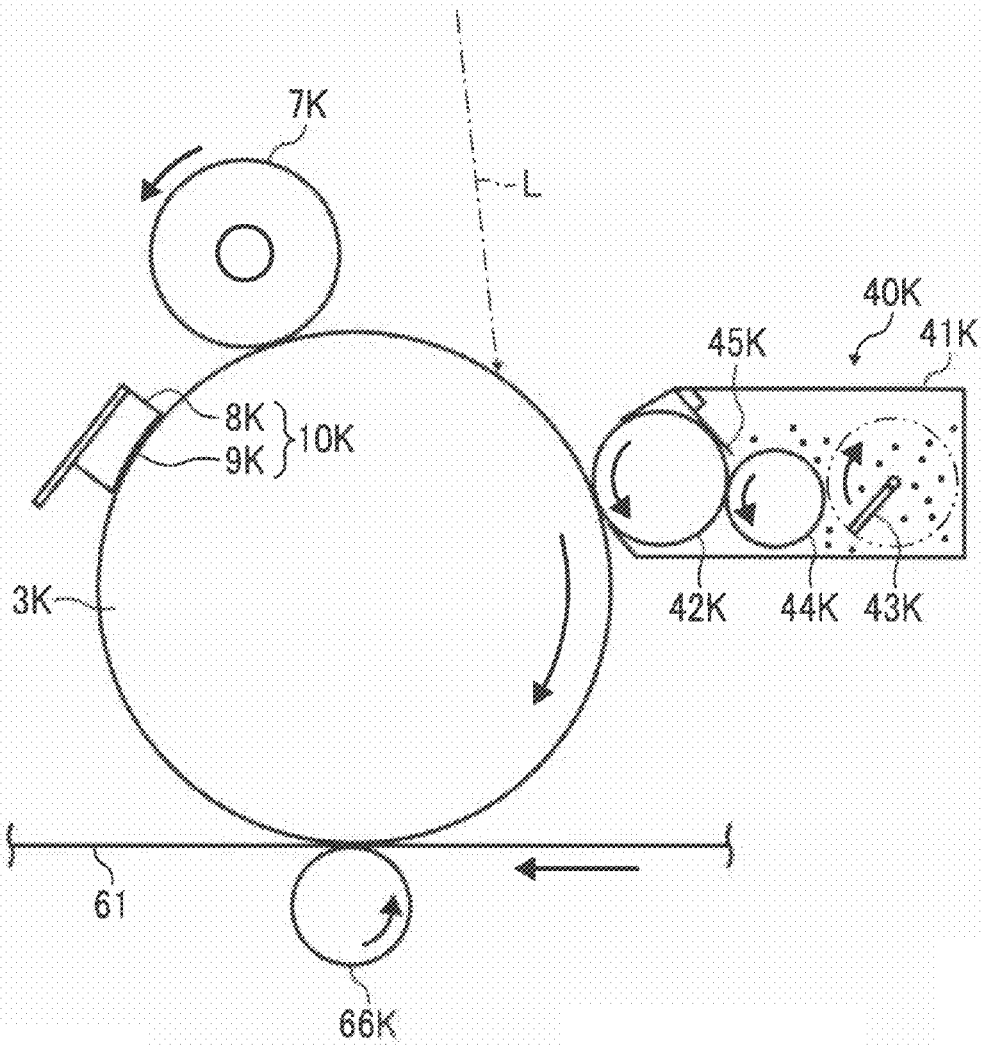
FIG. 1 schematically illustrates an exemplary embodiment of the process cartridge according to this specification.

FIG. 1 schematically illustrates an exemplary embodiment of the process cartridge according to this specification. The process cartridge includes an electrostatic latent image bearing member 3K, a charger 7K that charges the electrostatic latent image bearing member 3K, a developing device 40K, and a charging member 10K that recharges toner particles remaining on the electrostatic latent image bearing member 3K after transferring a toner image therefrom. The process cartridge is detachably mountable on image forming apparatuses such as copiers and printers.

The electrostatic latent image bearing member 3K is driven to rotate at a predetermined revolution. A circumferential surface of the electrostatic latent image bearing member 3K is uniformly charged to a predetermined positive or negative potential by the charger 7K while rotating. Subsequently, the charged surface is exposed to a light beam L containing image information emitted from an irradiator, such as a slit irradiator or a laser beam scanning irradiator, not shown, thus forming an electrostatic latent image thereon. The electrostatic latent image is then developed into a toner image by the developing device 40K. The toner image is then transferred onto a transfer material 61, which is fed between the electrostatic latent image bearing member 3K and a transfer device 66K from a paper feed part, not shown, in synchronization with rotation of the electrostatic latent image bearing member 3K.

The transfer material 61 having the toner image thereon is separated from the surface of the electrostatic latent image bearing member 3K and introduced into a fixing device, not shown. The toner image is fixed on the transfer material 61 in the fixing device, and is discharged from an image forming apparatus as a copy or a print.

After the toner image is transferred from the electrostatic latent image bearing member 3K, the charging member 10K recharges residual toner particles remaining on the electrostatic latent image bearing member 3K. The charging member 10K comprises an elastic member 8K and a conductive member 9K. The recharged toner particles pass by the charger 7K and are collected in the developing device 40K to be recycled in the next image forming opearation.

The developing device 40K includes a casing 41K and a developing roller 42K. The circumferential surface of the developing roller 42K is partially exposed from an opening provided on the casing 41K.

The developing roller 42K contains a shaft, and both ends of the shaft in the longitudinal direction are rotatably supported with bearings, not shown.

The casing 41K contains black toner particles according to this specification, and the toner particles are fed from right to left in FIG. 1 by rotation of an agitator 43K.

A toner supply roller 44K is provided on the left side of the agitator 43K in FIG. 1. The toner supply roller 44K is driven to rotate counterclockwise in FIG. 1 by a driving source, not shown. The toner supply roller 44K is comprised of an elastic foam, such as a sponge, and reliably captures the toner particles fed from the agitator 43K.

The toner supply roller 44K supplies the captured toner particles to the developing roller 42K at the contact point with the developing roller 42K.

The developing roller 42K rotates counterclockwise in FIG. 1 while bearing the toner particles. The toner particles on the developing roller 42K pass through a control blade 45K along rotation of the developing roller 42K, so that the thickness of the toner particles layer is controlled and the toner particles are frictionally charged. The toner particles finally fed to a developing area formed between the developing roller 42K and the electrostatic latent image bearing member 3K.

The conductive member 9K of the charging member 10K is preferably comprised of a conductive material rather than insulative materials. Insulative materials are likely to cause charge-up, thereby disadvantageously adhering toner particles thereto.

Specific examples of suitable conductive materials include, but are not limited to, nylon, PTFE, PVDF, and urethane. Among these materials, PTFE and PVDF are preferable for charging toner particles.

The conductive material preferably has a surface resistivity of from $10^2$ to $10^8$ Ω/sq and a volume resistivity of from $10^1$ to $10^6$ Ω/sq.

The conductive material may be in the shape of a roller, a brush, or a sheet, and is preferably in the shape of a sheet in view of removability of toner particles therefrom.

The voltage applied to the charging member 10K is preferably from −1.4 to 0 kV for charging toner particles.

When the conductive material is in the form of a sheet, the thickness thereof is preferably from 0.05 to 0.5 mm in view of the contact pressure with the electrostatic latent image bearing member 3K.

The nip between the charging member 10K and the electrostatic latent image bearing member 3K preferably has a width of from 1 to 10 mm in view of the contact time with the electrostatic latent image bearing member 3K.

Exemplary aspects of the present invention further provide an image forming apparatus. The image forming apparatus includes an electrostatic latent image bearing member that bears an electrostatic latent image; a charger that uniformly charges a surface of the electrostatic latent image bearing member; an irradiator that emits light containing image information onto the charged surface of the electrostatic latent image bearing member to form an electrostatic latent image thereon; a developing device that supplies toner particles to the electrostatic latent image to form a toner image that is visible; a transfer device that transfers the toner image from the electrostatic latent image bearing member onto a transfer material; and a fixing device that fixes the toner image on the transfer material. The image forming apparatus may optionally include a neutralizer, a cleaner, a recycler, and/or a controller, for example.

Exemplary aspects of the present invention further provide an image forming method. The image forming method includes the processes of uniformly charging a surface of an electrostatic latent image bearing member; irradiating the charged surface of the electrostatic latent image bearing member with light containing image information to form an electrostatic latent image thereon; developing the electrostatic latent image into a toner image that is visible, by forming a layer of toner particles having a predetermined thickness on a toner bearing member; transferring the toner image from the electrostatic latent image bearing member onto a transfer member; and fixing the toner image on the transfer member. The image forming method may optionally include the processes of neutralizing, cleaning, recycling, and/or controlling, for example.

In the charging process, a surface of the electrostatic latent image bearing member is uniformly charged by the charger. In the irradiating process, the charged surface of the electrostatic latent image bearing member is irradiated with light containing image information, emitted from the irradiator, so that an electrostatic latent image is formed thereon.

In the developing process, a layer of toner particles is formed on the toner bearing member (e.g., a developing roller). The layer of toner particle is then brought into contact with the electrostatic latent image bearing member (e.g., a photoreceptor) so that the electrostatic latent image is developed into a toner image.

More specifically, in the developing device, toner particles are agitated with an agitator to be mechanically supplied to a toner supply member. The toner supply member supplies the toner particles to the toner bearing member, thereby accumulating the toner particles on the toner bearing member. The accumulated toner particles on the toner bearing member pass through a toner layer regulator, provided in contact with a surface of the toner bearing member, so as to be formed into a uniform thin layer while being frictionally charged. The toner particles thus charged are adhered to the electrostatic latent image formed on the electrostatic latent image bearing member, thus forming a toner image.

In the transferring process, the transfer device (e.g., a transfer charger) transfers the toner image from the electrostatic latent image bearing member onto the transfer material (e.g., a recording medium).

In the fixing process, the fixing device fixes the toner image on the transfer material. The fixing process may be performed after each transferring process, or after multiple transferring processes. In the latter case, a multilayer toner image is transferred onto the transfer material at once.

The fixing device preferably includes a heating member and a pressing member. For example, the heating member may be in a form of a roller, and the pressing member may be in a form of a roller or an endless belt. The heating member heats toner images to 80 to 200° C.

Figure 2:
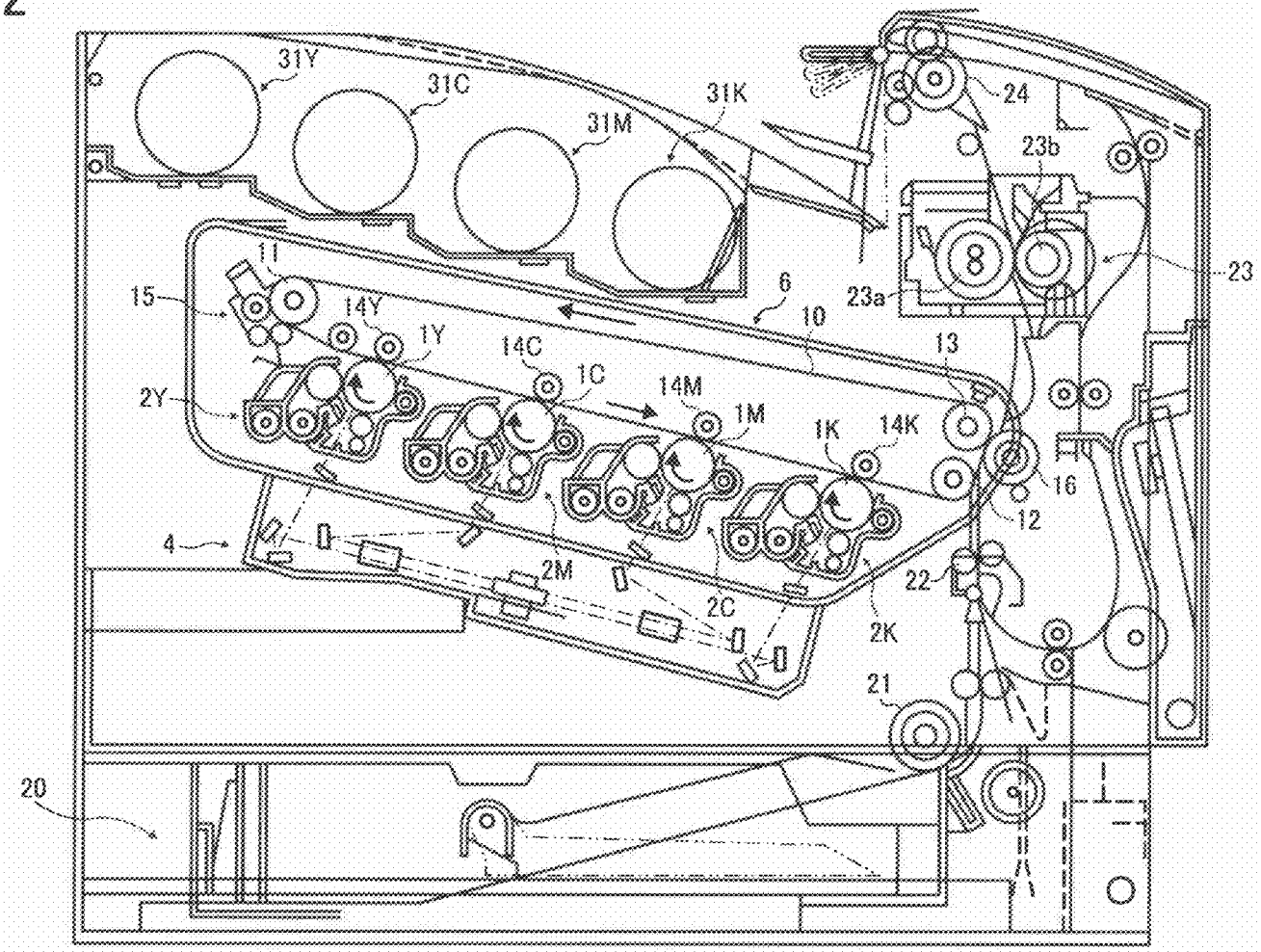
FIG. 2 schematically illustrates an exemplary embodiment of the image forming apparatus according to this specification.

FIG. 2 schematically illustrates an exemplary embodiment of the image forming apparatus according to this specification.

The image forming apparatus illustrated in FIG. 2 includes multiple image forming units 2Y, 2C, 2M, and 2K including respective photoreceptors 1Y, 1C, 1M, and 1K, each serving as an electrostatic latent image bearing member. The photoreceptors 1Y, 1C, 1M, and 1K are arranged in tandem along the direction of movement of a surface of an intermediate transfer belt 10. The photoreceptors 1Y, 1C, 1M, and 1K illustrated in FIG. 2 each have a drum shape, or alternatively, the photoreceptors may be in the form a sheet.

Each of the photoreceptors 1Y, 1C, 1M, and 1K is driven to rotate clockwise in FIG. 2 while contacting the intermediate transfer belt 10.

Each of the photoreceptors 1Y, 1C, 1M, and 1K is comprised of a relatively thin cylindrical conductive support, a photosensitive layer formed on the conductive support, and a protective layer formed on the photosensitive layer. An intermediate layer may be optionally formed between the photosensitive and protective layers.

Figure 3:
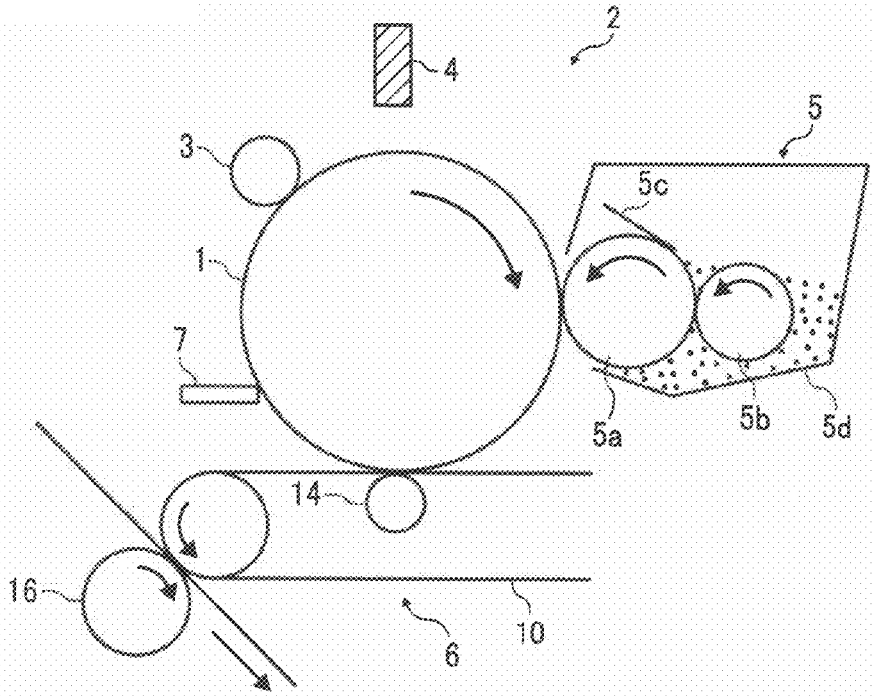
FIG. 3 is a magnified view of the image forming units illustrated in FIG. 2.

FIG. 3 is a magnified view of the image forming units 2Y, 2C, 2M, and 2K illustrated in FIG. 2. Since the image forming units 2Y, 2C, 2M, and 2K have the same configuration, the additional characters Y, C, M, and K representing toner colors of yellow, cyan, magenta, and black, respectively, are omitted.

A charger 3, a developing device 5, a transfer device 6, and a cleaner 7 are provided in this order along the direction of movement of the surface of the photoreceptor 1. The transfer device 6 transfers a toner image from the photoreceptor 1 onto the intermediate transfer belt 10. The cleaner 7 removes residual toner particles remaining on the photoreceptor 1 after the toner image is transferred onto the intermediate transfer belt 10.

A space is provided between the charger 3 and the developing device 5 along the circumferential surface of the photoreceptor 1 so that an irradiator 4 can emit light containing image information onto the charged surface of the photoreceptor 1 to form an electrostatic latent image thereon.

The charger 3 charges a surface of the photoreceptor 1 to a negative polarity. In the present embodiment illustrated in FIG. 3, the charger 3 is comprised of a charging roller. The charging roller is in contact with or adjacent to the photoreceptor, and a negative charging bias is applied thereto. Specifically, the charging bias being a direct current is applied to the charging roller so that the photoreceptor has a surface potential of −500 V. Alternatively, the charging bias may be a direct current overlapped with an alternating current.

The charger 3 may further include a cleaning brush for cleaning the surface of the charging roller.

Both ends of the charging roller in the axial direction may be wrapped around with a thin film, and the wrapped-around thin film may be brought into contact with the surface of the photoreceptor 1. In this case, a thin gap, having the same thickness as the thin film, is formed between the surfaces of the charging roller and the photoreceptor 1, thus causing electric discharge in the gap upon application of the charging bias to the charging roller. As a result, the surface of the photoreceptor 1 is charged.

The surface of the photoreceptor 1 thus charged is then irradiated with light emitted from the irradiator 4 so that an electrostatic latent image is formed thereon. The light contains image information of each color.

In the present embodiment illustrated in FIG. 3, the irradiator 4 is a laser irradiator, or alternatively, other irradiators using an LED array, an imaging unit, etc. can also be used.

Referring back to FIG. 2, toner bottles 31Y, 31C, 31M, and 31K supply respective yellow, cyan, magenta, and black toners to the corresponding developing devices 5. Referring back to FIG. 3, the toner particles supplied to the developing device 5 are fed to a developing roller 5*a* by a toner supply roller 5*b*. The toner particles on the toner developing roller 5*a* are further carried to a developing area formed between the developing roller 5*a* and the photoreceptor 1.

In the developing area, a surface of the developing roller 5*a* rotates at a higher linear speed than the photoreceptor 1 in the same direction as the movement of a surface of the photoreceptor 1. The toner particles on the developing roller 5*a* abrasively contact the surface of the photoreceptor 1, while a developing bias of −300 V is applied to the developing roller 5*a* from an electric source, not shown. Thus, a developing electric field is formed between the photoreceptor 1 and the developing roller 5*a* in the developing area, and the toner particles are moved toward the photoreceptor 1 by an electrostatic force. Consequently, the toner particles are adhered to the electrostatic latent image on the photoreceptor, resulting in development of a toner image.

Referring back to FIG. 2, the intermediate transfer belt 10 is stretched taut with support rollers 11, 12, and 13, and endlessly moves counterclockwise in FIG. 1. Toner images formed on each of the photoreceptors 1Y, 1C, 1M, and 1K are electrostatically transferred onto the intermediate transfer belt 10 and superimposed on one another.

In the present embodiment illustrated in FIG. 2, the toner images are electrostatically transferred onto the intermediate transfer belt 10 by primary transfer rollers 14Y, 14C, 14M, and 14K, which causes less toner scattering compared to the case using transfer chargers.

The primary transfer rollers 14Y, 14C, 14M, and 14K are arranged facing the back side of the intermediate transfer belt 10.

The primary transfer rollers 14Y, 14C, 14M, and 14K are pressed against the respective photoreceptors 1Y, 1C, 1M, and 1K with the intermediate transfer belt 10 therebetween, thus forming primary transfer nips between the photoreceptors 1Y, 1C, 1M, and 1K and the intermediate transfer belt 10.

Upon application of a positive bias to the primary transfer rollers 14Y, 14C, 14M, and 14K, transfer electric fields are formed within the primary transfer nips, thereby electrostatically transferring toner images from the photoreceptors 1Y, 1C, 1M, and 1K onto the intermediate transfer belt 10.

A belt cleaner 15 that removes residual toner particles remaining on a surface of the intermediate transfer belt 10 is provided along the circumferential surface of the intermediate transfer belt 10. The belt cleaner 15 comprises a fur brush or a cleaning blade. The toner particles collected with the belt cleaner 15 are fed to a waste toner tank, not shown, through a feed path, not shown.

A secondary transfer roller 16 is provided facing the support roller 13 while contacting the intermediate transfer belt 10 therebetween. Thus, a secondary transfer nip is formed between the secondary transfer roller 16 and the intermediate transfer belt 10.

Multiple sheets of a transfer paper are stored in a paper feed cassette 20 provided below the irradiator 4. Each of the sheets is fed to the secondary transfer nip by a paper feed roller 21 and a pair of registration rollers 22 in synchronization with an entry of a composite toner image to the secondary transfer nip. The composite toner image is transferred onto the sheet of the transfer paper in the secondary transfer nip, while a positive bias is applied to the secondary transfer roller 16.

A fixing device 23 is provided downstream from the secondary transfer nip relative to the direction of feed of the transfer paper. The fixing device 23 includes a heating roller 23*a* that internally contains a heater and a pressing roller 23*b* that is pressed against the heating roller 23*a*, and the heating and pressing rollers 23*a* and 23*b* form a fixing nip therebetween. The transfer paper having a toner image thereon is fed from the secondary transfer nip to the fixing nip. In the fixing nip, heat and pressure are applied to the toner image so that the toner image fuses and fixes on the transfer paper. The transfer paper having the fixed toner image thereon is then discharged by a discharge roller 24 to a discharge tray provided on the top surface of the image forming apparatus.

Figure 4:
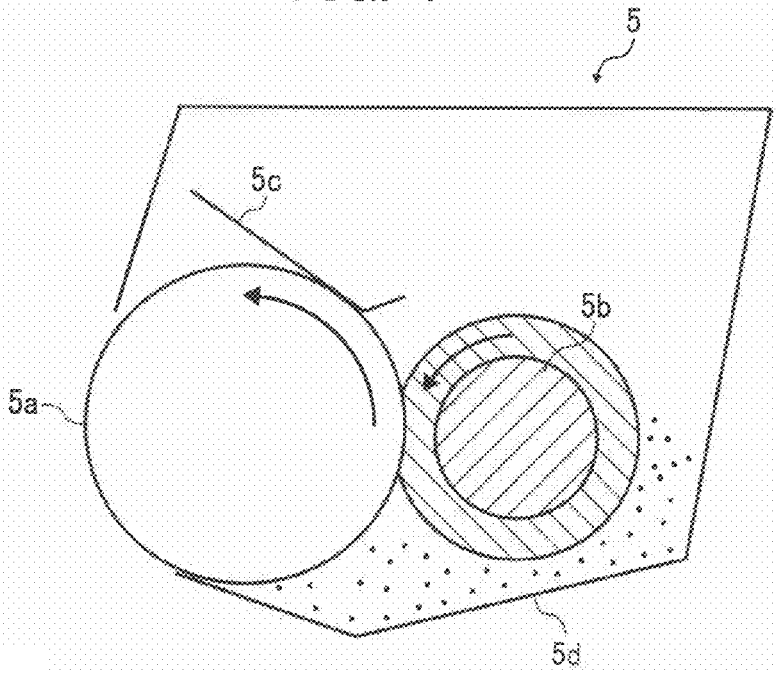
FIG. 4 is a magnified view of the developing device illustrated in FIG. 3.

FIG. 4 is a magnified view of the developing device 5 illustrated in FIG. 3. As illustrated, the developing roller 5*a* is exposed from an opening of a casing 5*d*. The developing device 5 contains a one component developer comprising toner particles and no carrier particles. Specifically, each of the developing devices 5 contains respective yellow, cyan, magenta, and black toners supplied from the respective toner bottles 31Y, 31C, 31M, 31K illustrated in FIG. 2.

The toner bottles 31Y, 31C, 31M, 31K are detachably mounted on the image forming apparatus, and are independently replaceable without replacing other components when the toner is out, resulting in cost reduction.

Referring back to FIG. 4, the toner supply roller 5*b* agitates and feeds the toner particles toward the nip formed between the photoreceptor 1 and the developing roller 5*a*. Both the toner supply roller 5*b* and the developing roller 5*a* rotate counterclockwise in FIG. 4, so as to rotate in the opposite direction in the nip therebetween.

A control blade 5*c* is provided contacting the developing roller 5*a*. The control blade 5*c* controls the thickness of the toner particles on the developing roller 5*a*, to form a thin layer of the toner particles. Simultaneously, the toner particles are charged to a proper charge amount while passing through the nip between the toner supply roller 5*b* and the developing roller 5*a* and the other nip between the control blade 5*c* and the developing roller.

Figure 5:
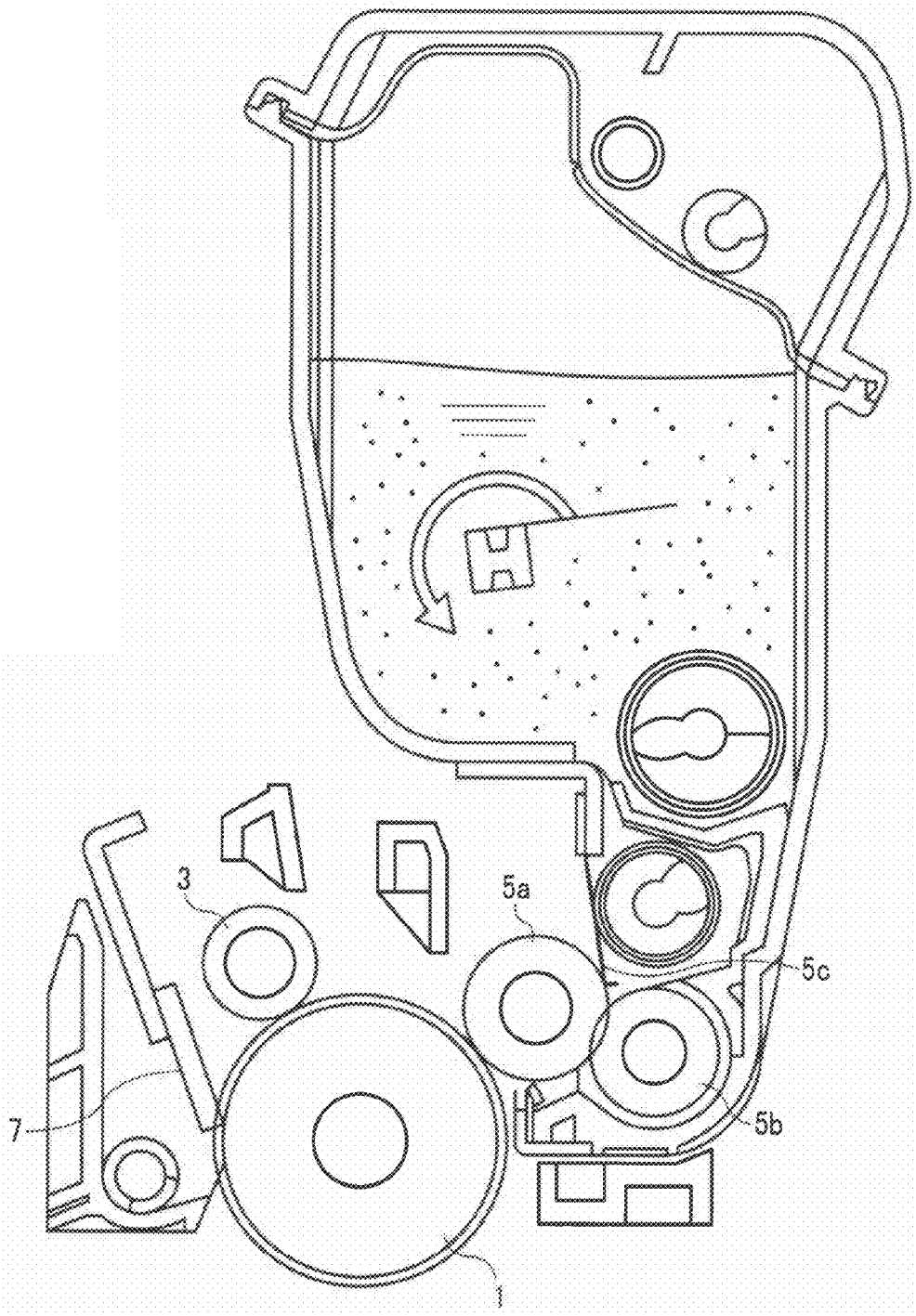
FIG. 5 schematically illustrates another exemplary embodiment of the process cartridge according to this specification.

FIG. 5 schematically illustrates another exemplary embodiment of the process cartridge according to this specification. The process cartridge illustrated in FIG. 5 integrally supports the photoreceptor 1, the charger 3, the developing device 5 including the developing roller 5*a*, the toner supply roller 5*b*, and the control blade 5*c*, and the cleaner 7, and contains the above-described toner according to this specification. The process cartridge is detachably mountable on image forming apparatuses such as copiers and printers.

Next, a method of manufacturing the toner according to this specification is described below.

First, a process of preparing the oily liquid is described. A binder resin, a colorant, and other components are gradually dissolved or dispersed in an organic solvent while being agitated. In a case where the colorant is a pigment, or in a case where a release agent and/or a charge controlling agent which are hardly soluble to the organic solvent are to be added, it is preferable that such pigment, release agent, and charge controlling agent are pulverized into smaller particles before being added to the organic solvent.

As described above, the colorant can be mixed with a resin to be used as a master batch. Similarly, the release agent and the charge controlling agent can also be mixed with a resin to be used as a master batch.

Alternatively, the colorant, the release agent, and the charge controlling agent can be dispersed in the organic solvent in the presence of a dispersing auxiliary agent, to prepare a wet master batch.

In a case where the colorant, the release agent, and the charge controlling agent (hereinafter collectively "dispersoids") melt at temperatures below the boiling point of the organic solvent, the dispersoids may be dissolved in the organic solvent by application of heat while being agitated, optionally in the presence of a dispersing auxiliary agent. Subsequently, the resulting solution may be cooled while being agitated, so that the dispersoids may be crystallized.

The dispersoids subjected to any of the above-described dispersion treatments are then dissolved or dispersed in the organic solvent along with the binder resin. The resulting solution or dispersion may be further subjected to a dispersion treatment using a disperser, such as a bead mill or a disc mill.

Next, a process of preparing the core particles is described. The above-prepared oily liquid is dispersed in an aqueous medium containing a surfactant. The resulting dispersion contains oil droplets comprising the oily liquid.

The oil droplets are to be formed into the core particles. The oily liquid is dispersed in the aqueous medium using a low-speed shearing disperser, a high-speed shearing disperser, a frictional disperser, a high-pressure jet disperser, or a ultrasonic disperser, for example. A high-speed shearing disperser is preferable so as to control the particle diameter of the dispersing oil droplets into 2 to 20 μm. In this case, the revolution is preferably from 1,000 to 30,000 rpm, and more preferably from 5,000 to 20,000 rpm.

The dispersing time is preferably from 0.1 to 5 minutes. When the dispersing time is too long, undesired small-size particles may remain or undesired aggregations and coarse particles may be produced due to excessive dispersion.

The dispersing temperature is preferably from 0 to 40° C., and more preferably from 10 to 30° C. When the dispersing temperature is too high, dispersion stability deteriorates because molecular motion is activated. As a result, undesired aggregations and coarse particles may be produced. When the dispersing temperature is too low, the viscosity of the dispersion is so high that the larger shearing force is required, which results in low manufacture efficiency.

Specific examples of usable surfactants contained in the aqueous medium include the above-described surfactants preferably used for the process of preparing the vinyl resin particles. In particular, disulfonates having a relatively high HLB (i.e., hydrophile-lipophile balance) are preferable for efficiently dispersing oil droplets. The aqueous medium preferably contains the surfactant in an amount of from 1 to 10% by weight, more preferably from 2 to 8% by weight, and most preferably from 3 to 7% by weight. When the amount of the surfactant is too small, the resulting oil droplets may be too small or too large because dispersion stability deteriorates due to production of inverted micelles. When the amount of the surfactant is too large, the oil droplets cannot be reliably dispersed and coalesce into larger droplets.

Next, a process of adhering the vinyl resin particles to the core particles is described. The above-prepared oil droplets, to be formed into the core particles, are reliably dispersed in the aqueous medium while agitating. To adhere the vinyl resin particles on the surfaces of the core particles, the dispersion of the vinyl resin particles is added to the dispersion of the oil droplets while being agitated, preferably over a period over 30 seconds or more. When the period of adding the vinyl resin particle dispersion is too short, the vinyl resin particles may aggregate or unevenly adhere to the oil droplets, because the dispersion stability deteriorates. When the period of adding the vinyl resin particle dispersion is too long, for example, 60 minutes or more, production efficiency may deteriorate.

The dispersion of the vinyl resin particles may be diluted or condensed for the purpose of controlling the concentration of the vinyl resin particles, before being added to the dispersion of the oil droplets. The dispersion preferably includes the vinyl resin particles in an amount of from 5 to 30% by weight, and more preferably from 8 to 20% by weight. When the concentration of the vinyl resin particles is too small, the concentration of the organic solvent in the oil droplet dispersion may considerably vary, resulting in insufficient adherence of the vinyl resin particles to the core particles. When the concentration of the vinyl resin particles is too large, the vinyl resin particles may localize in the oil droplet dispersion, resulting in uneven adherence of the vinyl resin particles to the core particles.

The vinyl resin particles can stiffly adhere to the oil droplets through the above-described processes. One reason is that the oil droplets can flexibly deform their shape when contacting the vinyl resin particles, so that the contact area between the oil droplets and the vinyl resin particles is sufficiently widened. Another reason is that the vinyl resin particles are swelled or dissolved by the organic solvent contained in the oil droplets, so that the vinyl resin particles can more fixedly adhere to the oil droplets. Accordingly, the dispersion of the oil droplets preferably contains a sufficient amount of the organic solvent. Specifically, the dispersion of the oil droplets preferably includes the organic solvent in an amount of from 50 to 150% by weight, and more preferably from 70 to 125% by weight, based on the total weight of the solid components, such as the binder resin, the colorant, and optional release agent and/or charge controlling agent. When the concentration of the organic solvent is too large, toner productivity may deteriorates because dispersion stability deteriorates.

The vinyl resin particles are preferably adhered to the oil droplets at a temperature of from 10 to 60° C., and more preferably from 20 to 45° C. When the temperature is too high, a large amount of energy is required, resulting in increase of environmental load. Further, the vinyl resin particles, generally having a low acid value, existing at the surface may degrade dispersion stability of the oil droplets, resulting in production of coarse particles. When the temperature is too low, the viscosity of the oil droplets may be so high that the vinyl resin particles cannot adhere thereto.

Next, a process of removing the organic solvent from the resulting dispersion of toner particles is described. The organic solvent can be removed from the dispersion by gradually heating the dispersion, so that the organic solvent evaporates. Alternatively, the organic solvent can be removed by spraying the dispersion into mist in dried atmosphere. Further, the organic solvent can be removed by reducing pressure while agitating the dispersion, so that the organic solvent evaporates. The above-described second and third methods can be combined with the first method.

The dried atmosphere in which the dispersion is sprayed into mist may be a heated gas, such as air, nitrogen gas, carbon dioxide gas, or combustion gas. Preferably, these gases are heated above the boiling point of the organic solvent. Such gases can be produced by a spray drier, a belt drier, or a rotary kiln, within a short period.

Next, a process of aging is described. In a case where the modified resin having a terminal isocyanate group is included in the oily liquid, the dispersion of the toner particles may be subjected to aging, to accelerate elongation and cross-linking of the isocyanate groups. The aging time is preferably from 10 minutes to 40 hours, and more preferably from 2 to 24 hours. The aging temperature is preferably from 0 to 65° C., and more preferably from 35 to 50° C.

Next, a process of washing is described. The dispersion of the toner particles may contain unnecessary residual materials such as the surfactant and the dispersing agent. Such materials can be removed from the dispersion by centrifugal separation, decompression filtering, or filter press. In a case where the removal is insufficient, the resulting toner cake may be re-dispersed in an aqueous medium and subjected to the above washing treatment again. In a case where the toner cake which results from the decompression filtering or the filter press still contains unnecessary residual materials therein, the toner cake may be further washed with an aqueous medium. In this case, the aqueous medium may be water or a mixed solvent of water with an alcohol (e.g., methanol, ethanol), for example. From the viewpoint of environmental load, water is preferable.

Next, a process of drying is described. The above-prepared toner cake still contains a large amount of moisture. The remaining aqueous medium can be removed by drying the toner cake with a dryer, such as a spry dryer, a vacuum freeze dryer, a reduced-pressure dryer, a static shelf dryer, a fluid tank dryer, a rotary dryer, and an agitation dryer. Preferably, the drying process is repeatedly performed until the resulting toner particles contain less than 1% of moisture. Because the resulting toner particles are likely to flocculate immediately after the drying process, such flocculates can be pulverized with a jet mill, a HENSCHEL MIXER, a SUPER MIXER, a coffee mill, an OSTER BLENDER, or a food processor.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the following examples, various properties are measured as follows.

Measurement of Particle Diameter of Toner

Particle diameter distribution of a toner is measured using a measuring instrument such as COULTER COUNTER TA-II or COULTER MULTISIZER II (both from Beckman Coulter K.K.). A measuring procedure is as follows. First, 0.1 to 5 ml of a surfactant (preferably alkylbenzene sulfonate) is added to 100 to 150 ml of an electrolyte (i.e., a 1% NaCl aqueous solution including a first grade sodium chloride, such as ISOTON-II from Coulter Electrons Inc.). Thereafter, 2 to 20 mg of the toner is added to the electrolyte and subjected to a dispersing treatment with an ultrasonic disperser for about 1 to 3 minutes to prepare a suspension liquid. The suspension liquid is then subjected to a measurement of the volume and number distributions of toner particles using the measuring instrument equipped with a 100-μm aperture. The volume average particle diameter (Dv) and the number average particle diameter (Dn) are calculated from the measured volume distribution and number distribution, respectively.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Accordingly, particles having a particle diameter of from 2.00 μm to less than 40.30 μm are measured.

Measurement of Particle Diameter of Vinyl Resin Particle

Particle diameter of vinyl resin particles is measured with an instrument UPA-150EX (from Nikkiso Co., Ltd.).

Measurement of Molecular Weight

A molecular weight distribution curve of a resin is obtained by gel permeation chromatography (GPC) under the following conditions.

Instrument: GPC-150C (from Waters Corporation)
Column: Shodex® KF 801-807 (from Showa Denko K.K.)
Temperature: 40° C.
Solvent: tetrahydrofuran (THF)
Flow rate: 1.0 mL/min
Sample concentration: 0.05%-0.6%
Sample injection volume: 0.1 mL
Detector: Refractive index detector Number average molecular weight (Mn) and weight average molecular weight (Mw) are calculated from the above-measured molecular distribution curve using a calibration curve created from monodisperse polystyrene standard samples, i.e., Showdex® STANDARD No. S-7300, S-210, S-390, S-875, S-1980, S-10.9, S-629, S-3.0, and S-0.580, and toluene.

Measurement of Glass Transition Temperature (Tg)

Glass transition temperature of a resin is measured using a TG-DSC system TAS-100 (from Rigaku Corporation) as follows. An aluminum sample container is charged with about 10 mg of a sample, and is placed on a holder unit and set in an electric furnace. The sample is heated from room temperature to 150° C. at a heating rate of 10° C./min, left for 10 minutes at 150° C., cooled to room temperature, and left for 10 minutes at room temperature. Thereafter, the sample is subjected to a DSC measurement by being heated to 150° C. at a heating rate of 10° C./min in nitrogen atmosphere. The resulting endothermic curve is analyzed with an analysis system of TAS-100 to calculate glass transition temperature. Specifically, an intersection of the baseline and a tangent line of the endothermic shows the glass transition temperature of the sample.

Measurement of Acid Value

Acid value of a resin is measured according to a method based on JIS K1557-1970 as follows. First, about 2 mg of a pulverized sample is precisely weighed. The weighed sample and 100 ml of a mixed solvent including toluene and ethanol (toluene/ethanol=2/1) are contained in a 200-ml conical flask, and mixed for 5 hours so that the sample dissolves in the mixed solvent. A phenolphthalein solution is further added thereto as an indicator. Then the resulting sample liquid is titrated with a 0.1N alcohol solution of potassium hydroxide (KOH). Acid value (AV) is calculated as follows:

$$AV=[(S-B)\times f\times 5.61]/W$$

wherein S (ml) represents the consumed amount of the KOH solution in the titration, B (ml) represents the consumed amount of the KOH solution in a blank titration, f represents a factor of the KOH solution, and W (g) represents the weight of the sample.

Measurement of Hydroxyl Value

Hydroxyl value of a resin is measured according to a method based on JIS K1557-1970 as follows. First, precisely 100 ml of a sample are contained in an eggplant flask and precisely 5 ml of an acetylating reagent are added thereto. The flask is heated in a bath set to 100±5° C. for about 1 to 2 hours, and taken out from the bath to stand to cool.

Thereafter, ion-exchange water is added to the flask, and the flask is shaken so as to decompose acetic anhydride. To completely decompose acetic anhydride, the flask is reheated in the bath for 10 minutes or more, and taken out from the bath to stand to cool. After washing the inner wall of the flask with an organic solvent, the liquid contained in the flask is potentiometrically titrated with an N/2 ethyl alcohol solution of potassium hydroxide using a glass electrode.

Measurement of Concentration of Solid Components in Oily Liquid

First, 2 g of an oily liquid is poured in a previously-weighed aluminum dish (having a weight of about 1 to 3 g) within 30 seconds, and weigh the oily liquid. The aluminum dish is then put in an oven at 150° C. for 1 hour to evaporate solvents. The aluminum dish is taken out from the oven and stands to cool. Thereafter, the total weight of the aluminum dish and the remaining solid components in the oily liquid is measured with an electron balance. The weight of the remaining solid components is calculated by subtracting the weight of the aluminum dish from the above-measured total weight of the aluminum dish and the remaining components. The concentration of the solid components in the oily liquid is calculated by dividing the weight of the remaining solid components by the weight of the oily liquid.

Preparation of Dispersion of Vinyl Resin Particle 1

A reaction vessel equipped with a condenser and a stirrer was charged with 0.7 parts of sodium dodecyl sulfate and 498 parts of ion-exchange water. The mixture was heated to 80° C. while being agitated so that the sodium dodecyl sulfate dissolved in the ion-exchange water. A solution of 2.6 parts of potassium persulfate in 104 parts of ion-exchange water was added to the mixture, and 15 minutes later, a monomer mixture including 200 parts of styrene monomer and 4.2 parts of n-octanethiol was further dropped therein over a period of 90 minutes. The resulting mixture was kept at 80° C. for 60 minutes so as to bring about a polymerization reaction, followed by cooling.

Thus, a white dispersion of vinyl resin particle 1 was prepared. To dry out the vinyl resin particles, 2 ml of the dispersion were contained in a petri dish and dried. The dried out vinyl resin particles had a number average molecular weight of 8,300, a weight average molecular weight of 16,900, and a glass transition temperature (Tg) of 83° C.

Preparation of Dispersion of Vinyl Resin Particle 2

A reaction vessel equipped with a condenser and a stirrer is charged with 0.7 parts of sodium dodecyl sulfate and 498 parts of ion-exchange water. The mixture is heated to 80° C. while being agitated so that the sodium dodecyl sulfate dissolves in the ion-exchange water. A solution of 2.6 parts of potassium persulfate in 104 parts of ion-exchange water is added to the mixture, and 15 minutes later, a monomer mixture including 191 parts of styrene monomer, 4 parts of butyl acrylate, 5 parts of methacrylic acid, and 4.2 parts of n-octanethiol is further dropped therein over a period of 90 minutes. The resulting mixture is kept at 80° C. for 60 minutes so as to bring about a polymerization reaction, followed by cooling.

Thus, a white dispersion of vinyl resin particle 2 is prepared. To dry out the vinyl resin particles, 2 ml of the dispersion are contained in a petri dish and dried. The dried out vinyl resin particles have a number average molecular weight of 8,000, a weight average molecular weight of 16,200, and a glass transition temperature (Tg) of 81° C.

Preparation of Dispersion of Vinyl Resin Particle 3

A reaction vessel equipped with a condenser and a stirrer is charged with 0.7 parts of sodium dodecyl sulfate and 498 parts of ion-exchange water. The mixture is heated to 80° C. while being agitated so that the sodium dodecyl sulfate dissolves in the ion-exchange water. A solution of 2.6 parts of potassium persulfate in 103 parts of ion-exchange water is added to the mixture, and 15 minutes later, a monomer mixture including 170 parts of styrene monomer, 20 parts of butyl acrylate, 10 parts of methacrylic acid, and 4.2 parts of n-octanethiol is further dropped therein over a period of 90 minutes. The resulting mixture is kept at 80° C. for 60 minutes so as to bring about a polymerization reaction, followed by cooling.

Thus, a white dispersion of vinyl resin particle 3 is prepared. To dry out the vinyl resin particles, 2 ml of the dispersion are contained in a petri dish and dried. The dried out vinyl resin particles have a number average molecular weight of 8,100, a weight average molecular weight of 16,600, and a glass transition temperature (Tg) of 78° C.

Preparation of Dispersion of Vinyl Resin Particle 4

A reaction vessel equipped with a condenser and a stirrer is charged with 0.7 parts of sodium dodecyl sulfate and 498 parts of ion-exchange water. The mixture is heated to 80° C. while being agitated so that the sodium dodecyl sulfate dissolves in the ion-exchange water. A solution of 2.5 parts of potassium persulfate in 101 parts of ion-exchange water is added to the mixture, and 15 minutes later, a monomer mixture including 150 parts of styrene monomer, 40 parts of butyl acrylate, 10 parts of methacrylic acid, and 4.1 parts of n-octanethiol is further dropped therein over a period of 90 minutes. The resulting mixture is kept at 80° C. for 60 minutes so as to bring about a polymerization reaction, followed by cooling.

Thus, a white dispersion of vinyl resin particle 4 is prepared. To dry out the vinyl resin particles, 2 ml of the dispersion are contained in a petri dish and dried. The dried out vinyl resin particles have a number average molecular weight of 8,300, a weight average molecular weight of 17,900, and a glass transition temperature (Tg) of 58° C.

Preparation of Dispersion of Vinyl Resin Particle 5

A reaction vessel equipped with a condenser and a stirrer is charged with 0.7 parts of sodium dodecyl sulfate and 498 parts of ion-exchange water. The mixture is heated to 80° C. while being agitated so that the sodium dodecyl sulfate dissolves in the ion-exchange water. A solution of 2.5 parts of potassium persulfate in 100 parts of ion-exchange water is added to the mixture, and 15 minutes later, a monomer mixture including 126 parts of styrene monomer, 60 parts of butyl acrylate, 14 parts of methacrylic acid, and 4 parts of n-octanethiol is further dropped therein over a period of 90 minutes. The resulting mixture is kept at 80° C. for 60 minutes so as to bring about a polymerization reaction, followed by cooling.

Thus, a white dispersion of vinyl resin particle 5 is prepared. To dry out the vinyl resin particles, 2 ml of the dispersion are contained in a petri dish and dried. The dried out vinyl resin particles have a number average molecular weight of 8,400, a weight average molecular weight of 18,200, and a glass transition temperature (Tg) of 41° C.

The monomer compositions and the properties of the above-prepared vinyl resin particles 1 to 5 are summarized in Tables 1-1 and 1-2, respectively.

TABLE 1-1

| Vinyl Resin | Monomers (parts) | | | Chain Transfer |
|---|---|---|---|---|
| Particle No. | Styrene | Butyl Acrylate | Methacrylic Acid | Agent (parts) n-Octanethiol |
| 1 | 100 | — | — | 4.2 |
| 2 | 95.5 | 2 | 2.5 | 4.2 |
| 3 | 85 | 10 | 5 | 4.2 |
| 4 | 75 | 20 | 5 | 4.1 |
| 5 | 64 | 30 | 6 | 4.0 |

TABLE 1-2

| Vinyl Resin Particle No. | Number Average Molecular Weight | Weight Average Molecular Weight | Glass Transition Temperature (° C.) | Particle Diameter (nm) |
|---|---|---|---|---|
| 1 | 8,300 | 16,900 | 83 | 135 |
| 2 | 8,000 | 16,200 | 81 | 120 |
| 3 | 8,100 | 16,600 | 78 | 80 |
| 4 | 8,300 | 17,900 | 58 | 100 |
| 5 | 8,400 | 17,200 | 41 | 128 |

Preparation of Polyester 1

A reaction vessel equipped with a condenser, a stirrer, and a nitrogen inlet pipe was charged with 229 parts of ethylene oxide 2 mol adduct of bisphenol A, 529 parts of propylene oxide 2 mol adduct of bisphenol A, 208 parts of terephthalic acid, 46 parts of adipic acid, and 2 parts of dibutyltin oxide. The mixture was subjected to reaction for 8 hours at 230° C. under normal pressures, and subsequently for 5 hours under reduced pressures of 10 to 15 mmHg. Thereafter, 44 parts of trimellitic anhydride were added thereto, and the mixture was further subjected to reaction for 2 hours at 180° C. under normal pressures. Thus, a polyester 1 was prepared. The polyester 1 had a number average molecular weight of 2,500, a weight average molecular weight of 6,700, a glass transition temperature of 43° C., and an acid value of 25 mgKOH/g.

Preparation of Polyester 2

A reaction vessel equipped with a condenser, a stirrer, and a nitrogen inlet pipe is charged with 270 parts of ethylene oxide 2 mol adduct of bisphenol A, 497 parts of propylene oxide 2 mol adduct of bisphenol A, 110 parts of terephthalic acid, 102 parts of isophthalic acid, 44 parts of adipic acid, and 2 parts of dibutyltin oxide. The mixture is subjected to reaction for 9 hours at 230° C. under normal pressures, and subsequently for 7 hours under reduced pressures of 10 to 18 mmHg. Thereafter, 40 parts of trimellitic anhydride are added thereto, and the mixture is further subjected to reaction for 2 hours at 180° C. under normal pressures. Thus, a polyester 2 is prepared. The polyester 2 has a number average molecular weight of 3,000, a weight average molecular weight of 8,600, a glass transition temperature of 49° C., and an acid value of 22 mgKOH/g.

Preparation of Polyester 3

A reaction vessel equipped with a condenser, a stirrer, and a nitrogen inlet pipe is charged with 218 parts of ethylene oxide 2 mol adduct of bisphenol A, 460 parts of propylene oxide 2 mol adduct of bisphenol A, 140 parts of terephthalic acid, 145 parts of isophthalic acid, and 2 parts of dibutyltin oxide. The mixture is subjected to reaction for 8 hours at 230° C. under normal pressures, and subsequently for 6 hours under reduced pressures of 10 to 18 mmHg. Thereafter, 24 parts of trimellitic anhydride are added thereto, and the mixture is further subjected to reaction for 2 hours at 180° C. under normal pressures. Thus, a polyester 3 is prepared. The polyester 3 has a number average molecular weight of 7,600, a weight average molecular weight of 21,000, a glass transition temperature of 57° C., and an acid value of 15 mgKOH/g.

Preparation of Isocyanate-Modified Polyester

A reaction vessel equipped with a condenser, a stirrer, and a nitrogen inlet pipe was charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture was subjected to reaction for 8 hours at 230° C. under normal pressures. Thus, an intermediate polyester 1 was prepared. The intermediate polyester 1 had a number average molecular weight of 2,100, a weight average molecular weight of 9,500, a glass transition temperature of 55° C., an acid value of 0.5 mgKOH/g, and a hydroxyl value of 49 mgKOH/g.

Next, another reaction vessel equipped with a condenser, a stirrer, and a nitrogen inlet pipe was charged with 411 parts of the intermediate polyester 1, 89 parts of isophorone diisocyanate, and 500 parts of ethyl acetate. The mixture was subjected to reaction for 5 hours at 100° C. Thus, an isocyanate-modified polyester 1 was prepared. The isocyanate-modified polyester 1 included 1.53% by weight of free isocyanate.

Preparation of Master Batch 1

First, 40 parts of a cyan pigment (Pigment Blue 15:3), 60 parts of the polyester 1, and 30 parts of water were mixed with a HENSCHEL MIXER. The mixture was kneaded for 45 minutes with a double roll kneader while setting the roller surface temperature to 130° C., and then the cooled mixture was pulverized into small pieces of 1 mm. Thus, a master batch 1 was prepared.

Example 1

Preparation of Aqueous Medium

First, 970 parts of ion-exchange water, 40 parts of a 25% aqueous dispersion of an organic particulate resin (i.e., a copolymer of styrene, methacrylic acid, butyl acrylate, and a sodium salt of sulfate ester of ethylene oxide adduct of methacrylic acid), 95 parts of a 48.5% aqueous solution of dodecyl diphenyl ether sodium disulfonate, and 98 parts of ethyl acetate were mixed, thus preparing a mixture having a pH of 6.2. Next, a 10% aqueous solution of sodium hydroxide was dropped therein until the pH became 9.5. Thus, an aqueous medium 1 was prepared.

Preparation of Oily Liquid

A vessel equipped with a stirrer and a thermometer was charged with 545 parts of the polyester 1, 181 parts of a paraffin wax (having a melting point of 74° C.), and 1,450 parts of ethyl acetate. The mixture was heated to 80° C. while being agitated, then kept at 80° C. for 5 hours, and cooled to 30° C. over a period of 1 hour. Further, 500 parts of the master batch 1 and 100 parts of ethyl acetate were added to the vessel, and the mixture was agitated for 1 hour. Thus, a raw material liquid 1 was prepared.

Next, 1,500 parts of the raw material liquid 1 were contained in a vessel, and subjected to a dispersion treatment using a bead mill (ULTRAVISCOMILL (trademark) from Aimex Co., Ltd.) under the following conditions.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

After further adding 655 parts of a 66% ethyl acetate solution of the polyester 1, the above dispersion treatment was repeated except for changing the repeat number of dispersing operation to one. Thus, a colorant-wax dispersion 1 was prepared.

Next, 976 parts of the colorant-wax dispersion 1 were agitated for 1 minute using a TK HOMOMIXER (from PRIMIX Corporation) at a revolution of 5,000 rpm. Further, 88 parts of the isocyanate-modified polyester 1 were added thereto, and the mixture was agitated for 1 minute using a TK HOMOMIXER (from PRIMIX Corporation) at a revolution of 5,000 rpm. Thus, an oily liquid 1 was prepared. The oily liquid 1 contained solid components in an amount of 52.0% by weight based on the total weight of the oily liquid 1, and ethyl acetate in an amount of 92% by weight based on the total weight of the solid components.

Preparation of Core Particles

The oily liquid 1 was mixed with 1,200 parts of the aqueous medium 1 for 2 minutes using a TK HOMOMIXER at a revolution of from 8,000 to 15,000 rpm, while being cooled in a water bath, so that the mixture liquid was prevented from overheating with shear heat generated from the mixer and had a temperature of from 20 to 23° C. The mixture liquid was further agitated for 10 minutes using a THREE-ONE MOTOR equipped with anchor paddles at a revolution of from 130 to 350 rpm. Thus, a core particle slurry 1 was prepared. The core particle slurry 1 dispersed oil droplets, to be formed into core particles, in the aqueous medium.

Process of Adhering Vinyl Resin Particles to Core Particles

While agitating the core particle slurry 1 with a THREE-ONE MOTOR equipped with anchor paddles at a revolution of from 130 to 350 rpm at a liquid temperature of 22° C., a mixture of 106 parts of the dispersion of the vinyl resin particle 1 and 71 parts of ion-exchange water, the concentration of solid components of which was 15%, was dropped therein over a period of 3 minutes. Thereafter, the mixture was further agitated for 30 minutes at a revolution of from 200 to 450 rpm. Thus, a composite particle slurry 1 was prepared. A clear supernatant liquid was obtained after diluting 1 ml of the composite particle slurry 1 into 100 ml and subjecting it to centrifugal separation.

Process of Solvent Removal

In a vessel equipped with a stirrer and a thermometer, the composite particle slurry 1 was contained and agitated for 8 hours at 30° C. to remove the organic solvents. Thus, a dispersion slurry 1 was prepared. A clear supernatant liquid was obtained after diluting 1 ml of the dispersion slurry 1 into 100 ml and subjecting it to centrifugal separation.

Process of Washing and Drying

First, 100 parts of the dispersion slurry 1 was filtered under a reduced pressure to obtain a wet cake (i).

The wet cake (i) was mixed with 100 parts of ion-exchange water with a TK HOMOMIXER for 10 minutes at a revolution of 12,000 rpm, followed by filtering, to obtain a wet cake (ii).

The wet cake (ii) was mixed with 900 parts of ion-exchange water with a TK HOMOMIXER for 30 minutes at a revolution of 12,000 rpm while applying ultrasonic vibration thereto, followed by filtering under a reduced pressure. This operation was repeated until the re-slurry liquid had an electric conductivity of 10 μS/cm or less, to obtain a wet cake (iii).

The wet cake (iii) was mixed with a 10% aqueous solution of hydrochloric acid so that the re-slurry liquid had a pH of 4, followed by 30-minute mixing using a THREE-ONE MOTOR and filtering, to obtain a wet cake (iv).

The wet cake (iv) was mixed with 100 parts of ion-exchange water with a TK HOMOMIXER for 10 minutes at a revolution of 12,000 rpm, followed by filtering. This operation was repeated until the re-slurry liquid had an electric conductivity of 10 μS/cm or less, to obtain a wet cake (v).

The wet cake (v) was dried for 48 hours at 45° C. using a circulating air drier, followed by sieving with a screen having openings of 75 μm. Thus, a mother toner 1 was prepared.

FIG. 6 is an image of the mother toner 1, obtained with a scanning electron microscope (SEM). FIG. 7 is an image of a cross-section of the mother toner 1, obtained with a transmission electron microscope (TEM). FIGS. 6 and 7 show that the vinyl resin particles are uniformly adhered to the surface of the core particle to form a shell layer.

Next, 100 parts of the mother toner 1 were mixed with 1.5 parts of a hydrophobized silica H2000/4 from Clariant, having a particle diameter of 12 nm, and 0.5 parts of a hydrophobized silica RX50 from Nippon Aerosil Co., Ltd., having a particle diameter of 40 nm, using a HENSCHEL MIXER. Thus, a toner 1 was prepared.

Examples 2 to 6 and Comparative Examples 1 and 2

The procedure in Example 1 is repeated except for changing the vinyl resin particle and the polyester to those described in Table 2, to prepare toners 2 to 6 and comparative toners 7 and 8.

Figure 8:
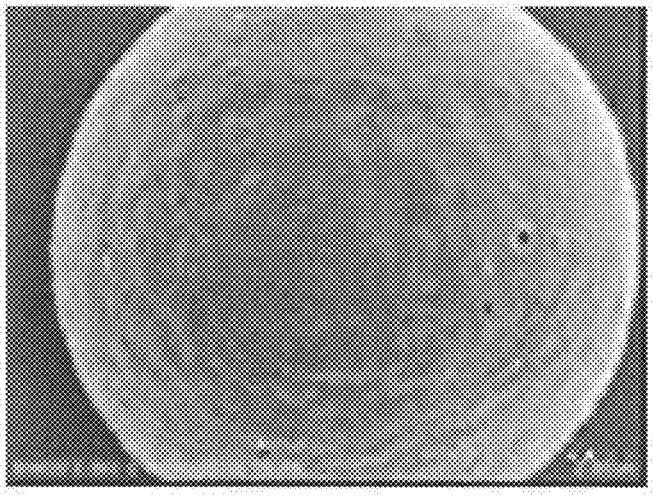
FIG. 8 is an image of a comparative mother toner, obtained with a scanning electron microscope (SEM)
Figure 9:
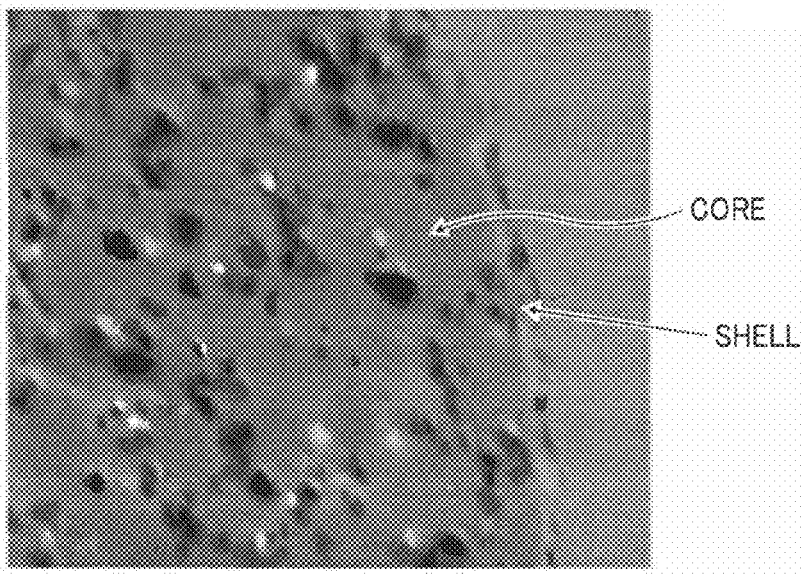
FIG. 9 is an image of a cross-section of a comparative mother toner, obtained with a transmission electron microscope (TEM).

FIG. 8 is an image of the comparative mother toner 8 (Comparative Example 2), obtained with a scanning electron microscope (SEM). FIG. 9 is an image of a cross-section of the comparative mother toner 8 (Comparative Example 2), obtained with a transmission electron microscope (TEM).

TABLE 2

| | High-Molecular Weight Resin | | Low-Molecular Weight Resin | | Release Agent | |
|---|---|---|---|---|---|---|
| | Resin | parts | Resin | parts | Wax | parts |
| Ex. 1 | Isocyanate-modified Polyester 1 | 10 | Polyester 1 | 90 | Paraffin Wax | 8 |
| Ex. 2 | Isocyanate-modified Polyester 1 | 10 | Polyester 1 | 90 | Paraffin Wax | 8 |
| Ex. 3 | Isocyanate-modified Polyester 1 | 10 | Polyester 1 | 90 | Paraffin Wax | 8 |
| Ex. 4 | Polyester 2 | 40 | Polyester 3 | 60 | Paraffin Wax | 8 |
| Ex. 5 | Polyester 2 | 40 | Polyester 3 | 60 | Paraffin Wax | 8 |
| Ex. 6 | Polyester 2 | 40 | Polyester 3 | 60 | Paraffin Wax | 8 |
| Comp. Ex. 1 | Isocyanate-modified Polyester 1 | 10 | Polyester 1 | 90 | Paraffin Wax | 8 |
| Comp. Ex. 2 | Isocyanate-modified Polyester 1 | 10 | Polyester 1 | 90 | Paraffin Wax | 8 |

The above prepared toners are subjected to the following evaluations. The results are shown in Table 3.

Evaluation of Background Fouling

A toner is set in an image forming apparatus IPSIO CX2500 (from Ricoh Co., Ltd.), and a print pattern with a B/W ratio of 6% is continuously produced on 1,000 sheets of paper at a monochrome printing mode, either under an N/N environment (i.e., 23° C., 45% RH) or an H/H environment (i.e., 27° C., 80% RH). Thereafter, toner particles remaining on the photoreceptor are transferred onto a mending tape (from Sumitomo 3M Limited), and subjected to a measurement of L* using a spectroscopic densitometer X-rite 939. The degree of background fouling is evaluated with the L* value and graded into the following four ranks.

Very good: L* is 90 or more.

Good: L* is 85 or more and less than 90.

Average: L* is 80 or more and less than 85.

Poor: L* is less than 80.

Evaluation of Separability

A toner is set in an image forming apparatus IPSIO CX2500 (from Ricoh Co., Ltd.), and an unfixed solid band image having a width of 36 mm including 9 g/m$^2$ of the toner is formed on a sheet of an A4-size paper in the longitudinal direction, leaving a margin having a width of 3 mm at the leading end of the sheet. The unfixed toner image is fixed on the sheet at various temperatures so as to determine a temperature at which the toner image is separable from the fixing member. The paper has a basis weight of 45 g/m$^2$ and a cross direction, which is hard for toner image to separate. The linear speed of the fixing device is 120 mm/sec.

Specifically, the fixing member is a heating roller having an outer diameter of 40 mm, comprising an aluminum cored bar containing a heater, an elastic layer comprised of a silicone rubber having a thickness of 1.5 mm, and a surface layer comprised of PFA (i.e., tetrafluoroethylene-perfluoroalkyl vinyl ether copolymer). A pressing roller, having an outer diameter of 35 mm, comprising an aluminum cored bar, an elastic layer comprised of a silicone rubber having a thickness of 3 mm, and a surface layer comprised of PFA, is pressed against the heating roller. The nip formed between the heating and pressing rollers has a width of 7 mm. It is to be noted that no oil is applied to the heating roller. Separability of each toner from the heating roller is evaluated as follows.

Very good: Separable temperature range is 50° C. or more.

Good: Separable temperature range is 30° C. or more and less than 50° C.

Poor: Separable temperature range is less than 30° C.

TABLE 3

| | Particle Diameter | | Background Fouling | | | | | Separability |
|---|---|---|---|---|---|---|---|---|
| | | | 23° C., 50% RH | | 27° C., 80% RH | | | Separable Temperature |
| | Dv (μm) | Dv/Dn | Rank | L* | Rank | L* | Rank | Range (° C.) |
| Ex. 1 | 6.1 | 1.14 | Very Good | 92 | Very Good | 91 | Very Good | 60 |
| Ex. 2 | 6.5 | 1.16 | Very Good | 92 | Good | 89 | Very Good | 50 |
| Ex. 3 | 6.4 | 1.13 | Good | 89 | Good | 86 | Good | 40 |
| Ex. 4 | 6.8 | 1.19 | Very Good | 91 | Very Good | 90 | Very Good | 55 |
| Ex. 5 | 6.5 | 1.18 | Very Good | 91 | Good | 87 | Good | 45 |
| Ex. 6 | 6.7 | 1.13 | Good | 88 | Good | 85 | Good | 40 |
| Comp. Ex. 1 | 6.4 | 1.14 | Average | 84 | Poor | 76 | Poor | 25 |
| Comp. Ex. 2 | 6.1 | 1.14 | Poor | 79 | Poor | 70 | Poor | 20 |

Additional modifications and variations of the present invention are possible in light of the above teachings. It is therefore to be understood that within the scope of the appended claims the invention may be practiced other than as specifically described herein.

What is claimed is:

1. A toner, comprising:

a core particle comprising a binder resin, a colorant, and a release agent; and a shell layer comprising particles of a vinyl resin, the vinyl resin comprising 80% by weight or more of a unit of an aromatic compound having a vinyl-polymerizable functional group.

2. The toner according to claim 1, wherein the vinyl resin comprises 90% by weight or more of the unit of an aromatic compound having a vinyl-polymerizable functional group.

3. The toner according to claim 1, wherein the vinyl resin consists of the unit of an aromatic compound having a vinyl-polymerizable functional group.

4. The toner according to claim 1, wherein the aromatic compound having a vinyl-polymerizable functional group is styrene.

5. The toner according to claim 1, wherein the binder resin has an acid value of from 2 to 24 mgKOH/g.

6. The toner according to claim 1, wherein the binder resin is a polyester resin.

7. The toner according to claim 1, wherein the core particle further comprises a reaction product of a modified resin having a terminal isocyanate group with an amine compound having a divalent or polyvalent amino group reactive with the terminal isocyanate group of the modified resin.

8. The toner according to claim 7, wherein the modified resin has a polyester skeleton.

9. The toner according to claim 1, wherein the toner has an average circularity of from 0.96 to 1.

10. A non-magnetic one component developer, comprising:

the toner according to claim 1.

11. A developing device, comprising:

a developer bearing member that bears the developer according to claim 10 and supplies the developer to an electrostatic latent image formed on an electrostatic latent image bearing member to develop the electrostatic latent image into a toner image;

a developer supply member that supplies the developer to the developer bearing member; and a developer regulator that controls a thickness of a layer of the developer formed on the developer bearing member, the developer regulator contacting the developer bearing member.

12. A process cartridge, comprising:

an electrostatic latent image bearing member that bears an electrostatic latent image; and the developing device according to claim 11.

13. An image forming apparatus, comprising:

an electrostatic latent image bearing member that bears an electrostatic latent image;

a charger that uniformly charges a surface of the electrostatic latent image bearing member;

an irradiator that emits light containing image information onto the charged surface of the electrostatic latent image bearing member to form an electrostatic latent image thereon;

the developing device according to claim 11;

a transfer device that transfers the toner image from the electrostatic latent image bearing member onto a transfer medium; and a fixing device that fixes the toner image onto the transfer medium.

14. An image forming method, comprising:

uniformly charging a surface of an electrostatic latent image bearing member;

irradiating the charged surface of the electrostatic latent image bearing member with light containing image information to form an electrostatic latent image thereon;

forming a layer of the developer according to claim 10 having a predetermined thickness on a developer bearing member by a developer regulator;

supplying the developer from the developer bearing member to the electrostatic latent image formed on the electrostatic latent image bearing member to develop the electrostatic latent image into a toner image;

transferring the toner image from the electrostatic latent image bearing member onto a transfer medium; and fixing the toner image onto the transfer medium.

15. A two-component developer, comprising:

the toner according to claim 1; and a carrier.

16. The toner according to claim 1, wherein the toner is manufactured by a method, comprising:

dissolving or dispersing the binder resin, the colorant, and the release agent in an organic solvent to prepare an oily liquid;

dispersing the oily liquid in an aqueous medium to prepare the core particles; and adhering particles of the vinyl resin to surfaces of the core particles to form shell layers.

17. A method of manufacturing toner, comprising:

dissolving or dispersing a binder resin, a colorant, and a release agent in an organic solvent to prepare an oily liquid;

dispersing the oily liquid in an aqueous medium to prepare core particles; and adhering particles of a vinyl resin to surfaces of the core particles to form shell layers, the vinyl resin comprising 80% by weight or more of a unit of an aromatic compound having a vinyl-polymerizable functional group.

* * * * *